US008183452B2

(12) United States Patent
Shirahama

(10) Patent No.: US 8,183,452 B2
(45) Date of Patent: May 22, 2012

(54) TONE GENERATION APPARATUS

(75) Inventor: Taro Shirahama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/052,919

(22) Filed: Mar. 21, 2011

(65) Prior Publication Data

US 2011/0232460 A1 Sep. 29, 2011

(30) Foreign Application Priority Data

Mar. 23, 2010 (JP) ..... 2010-066569
Mar. 23, 2010 (JP) ..... 2010-066570
Mar. 23, 2010 (JP) ..... 2010-066571

(51) Int. Cl.
*G10H 1/00* (2006.01)

(52) U.S. Cl. ..... 84/602; 84/604; 84/605; 84/606

(58) Field of Classification Search ..... 84/600–602, 84/604–607

See application file for complete search history.

(56) References Cited

U.S. PATENT DOCUMENTS 5,446,237 A * 8/1995 Abe et al. ..... 84/617
5,463,183 A 10/1995 Konno
5,742,695 A * 4/1998 Suggs ..... 381/104
5,809,342 A * 9/1998 Gulick ..... 710/64
5,892,170 A 4/1999 Ichiki et al.
5,918,302 A * 6/1999 Rinn ..... 84/604
5,955,691 A * 9/1999 Suzuki et al. ..... 84/604
5,977,469 A * 11/1999 Smith et al. ..... 84/627
6,064,743 A * 5/2000 Suggs ..... 381/104
6,858,790 B2 * 2/2005 Rossum ..... 84/603
6,989,485 B2 * 1/2006 Ochi ..... 84/645
7,186,910 B2 * 3/2007 Sakurai et al. ..... 84/622
7,385,132 B2 * 6/2008 Komano et al. ..... 84/615
7,420,115 B2 * 9/2008 Kawamoto et al. ..... 84/615
7,692,087 B2 * 4/2010 Okazaki et al. ..... 84/600
7,709,722 B2 * 5/2010 Shimizu ..... 84/600
RE41,757 E * 9/2010 Isozaki et al. ..... 84/603

(Continued)

FOREIGN PATENT DOCUMENTS

EP 0 747 878 B1 12/1996

(Continued)

OTHER PUBLICATIONS

European Search Report mailed Jul. 20, 2011, for EP Application No. 11159392.7, four pages.

*Primary Examiner* — David S. Warren
(74) *Attorney, Agent, or Firm* — Morrison & Foerster LLP

(57) ABSTRACT

Waveform data stored in an external memory are transferred from the external memory to an internal waveform memory and read out from the waveform memory to reproduce a tone. Transfer instruction is generated each time data readout from the waveform memory progresses by one page, and the transfer instruction is registered into a transfer queue. Thus, in response to the transfer instruction from the queue, the waveform data are read out on page by page from the external memory and stored into the waveform memory. The external memory also stores therein error correction code attached per page. As the waveform data are transferred from the external memory to the waveform memory, an error is detected using the error correction code, and if the error is correctable, the error is corrected. If the error is uncorrectable, volume of a tone being generated is rapidly attenuated, or a warning is issued.

19 Claims, 9 Drawing Sheets

U.S. PATENT DOCUMENTS

| | | | | |
|---|---|---|---|---|
| 7,807,914 | B2 * | 10/2010 | Kamath et al. | 84/603 |
| 7,979,609 | B2 * | 7/2011 | Hotta et al. | 710/62 |
| 8,035,021 | B2 * | 10/2011 | Shirahama et al. | 84/605 |
| 2003/0213357 | A1 * | 11/2003 | Sasaki | 84/609 |
| 2006/0060066 | A1 * | 3/2006 | Komano et al. | 84/609 |
| 2006/0137515 | A1 | 6/2006 | Kawamoto et al. | |
| 2006/0219088 | A1 * | 10/2006 | Okamura | 84/603 |
| 2006/0236848 | A1 * | 10/2006 | Stone et al. | 84/615 |
| 2006/0272482 | A1 * | 12/2006 | Tamura et al. | 84/604 |
| 2007/0000371 | A1 * | 1/2007 | Akazawa | 84/604 |
| 2008/0229917 | A1 * | 9/2008 | Devalapalli et al. | 84/645 |
| 2009/0025537 | A1 * | 1/2009 | Tamura et al. | 84/605 |
| 2010/0147138 | A1 | 6/2010 | Chamberlin et al. | |
| 2010/0236384 | A1 * | 9/2010 | Shirahama et al. | 84/605 |
| 2011/0232460 | A1 * | 9/2011 | Shirahama | 84/605 |

FOREIGN PATENT DOCUMENTS

| | | | |
|---|---|---|---|
| EP | 1 580 729 | A1 | 9/2005 |

* cited by examiner

TONE GENERATION APPARATUS

BACKGROUND

The present invention relates generally to tone generation apparatus based on a waveform memory scheme (i.e., waveform-memory-based tone generation apparatus), and more particularly to a tone generation apparatus which prestores waveform data in an external storage medium, such as a NAND-type flash memory and reproduces the waveform data while at the same time reading out the waveform data from the external storage medium to a waveform memory via a buffer.

Heretofore, there have been known tone generation apparatus which prestore waveform data in a hard disk (HD) and reproduce the waveform data while at the same time reading out the waveform data from the hard disk to a buffer and then from the buffer to a waveform memory, as disclosed, for example, in Japanese Patent Nos. 2671747 and 4089687 (patent literatures 1 and 2). In such tone generation apparatus, the actual start of tone generation would be undesirably delayed because the waveform data prestored in the hard disk are reproduced by being read out to the waveform memory via the buffer in response to a tone generation instruction, and thus, arrangements are made to pre-read a leading portion of the waveform data from the hard disk into the waveform memory upon powering-on of the tone generation apparatus. Then, in response to a tone generation instruction, the tone generation apparatus immediately start reproducing the leading portion of the waveform data from the waveform memory and read out a succeeding portion of the waveform data from the hard disk to the waveform memory via the buffer during the reproduction of the leading portion. Upon apparatus reproduce the succeeding portion of the waveform data already read out to the waveform memory, during which time the apparatus read out a further succeeding portion of the waveform data. By repeating the aforementioned operations, the tone generation apparatus continues the reproduction. In the aforementioned manner, the tone generation apparatus can start tone generation with no delay upon receipt of a tone generation instruction.

With the aforementioned waveform-memory-based scheme, each time one cluster of waveform data (sample data) read into the buffer is read out from the buffer to the waveform memory (i.e., the buffer is emptied), a transfer request interrupt is issued to a CPU. In response to such a transfer request interrupt, the CPU designates another cluster of the waveform data, stored in the hard disk, to be read out next and instructs a transfer section to transfer the cluster from the hard disk to the buffer. Therefore, the operation for interrupting the CPU is an essential operation.

Further, among such conventionally-known waveform-memory-based tone generators using a burst transfer is a technique disclosed in Japanese Patent No. 3163984 (patent literature 3). The technique disclosed in patent literature 3 is arranged to temporarily store waveform samples, read out from a waveform memory, into a buffer memory and then generate a tone by selectively reading out necessary waveform samples from the buffer memory. Such readout of the waveform samples from the waveform memory to the buffer memory is performed through burst transfer, a plurality of samples at a time. Such a burst transfer can achieve reduced access time.

Recent years have seen increased capacity and reduced cost of a NAND-type flash memory, and attempts have been made to use a NAND-type flash memory along with a hard disk as a large-capacity storage means in various apparatus. Although the NAND-type flash memory requires a long time to make instant access to a page (corresponding to a cluster of the hard disk), it can achieve a quick data transfer speed after the start of the instant access. Further, error correction based on error correction code is essential.

However, the tone generation apparatus using the hard disk would present the inconvenience that an access speed to the hard disk becomes a bottleneck so that the number of channel capable of simultaneously reproducing tones is limited, although it is desirable to maximize the number of channels capable of simultaneously generating or reproducing tones in the tone generation apparatus. One conceivable way to maximize the number of channels capable of simultaneously reproducing tones is to use a NAND-type flash memory in place of the hard disk. Because the NAND-type flash memory can achieve a markedly quick data transfer speed as compared to the hard disk, it can significantly reduce the size of each cluster (page), which is a minimum readout unit, e.g., by a factor of ten or below. In such a case, however, a frequency at which a transfer request interrupt is issued to the CPU would considerably increase by a factor of ten or over. Namely, in the case where the NAND-type flash memory is used as a memory for storing waveform data to be used in a tone generator, a frequency at which control by the CPU, controlling the tone generator, is required would increase, so that there would occur the problem that a burden on the CPU increases to a considerably degree. Therefore, it is desired that control heretofore performed by the CPU in accordance with processing programs in the tone generation apparatus using the hard disk be performed by dedicated hardware circuit device of a tone generator provided in the tone generator using the NAND-type flash memory.

Further, data read out from the NAND-type flash memory are more likely to contain an error than data read out from other types of memories, and thus, when storing data into the NAND-type flash memory, it is essential to store the data with error correction code attached to the data per page. The hard disk would present a similar data error problem, but, in the conventionally-known tone generation apparatus using the hard disk, it has been customary for data correction to be automatically performed as a firmware process of a processor within the hardware device. Consequently, there would be undesirably caused as time delay from a time when an address is supplied for the intervening processor to a time when data can be obtained. Therefore, in the tone generation apparatus using the NAND-type flash memory, it is desirable, in order to achieve an increased access speed, that no processor intervene between an LSI of the NAND-type flash memory and an LSI of the tone generation apparatus. In such a case, however, the NAND-type flash memory undesirably cannot perform data correction on its own.

Tone generators (tone generation apparatus) having waveform data stored in a NAND-type flash memory are available in the market today, and these tone generators are each constructed in such a manner that, prior to tone generation by the tone generator, a CPU reads out all of necessary waveform data from the NAND-type flash memory, corrects errors in the read-out waveform data and then stores the error-corrected waveform data into a waveform memory implemented by a RAM. In this case, however, the waveform data would be undesirably limited in size due to the size of the waveform memory implemented by a RAM.

SUMMARY OF THE INVENTION

In view of the foregoing, it is an object of the present invention to provide an improved tone generation apparatus which has waveform data prestored in an external storage medium, such as a NAND-type flash memory, and reproduces the waveform data while at the same time reading out the waveform data to a waveform memory via a buffer, and which can reduce a burden on a CPU and can perform error detection and correction on the data read out from the external storage medium, such as a NAND-type flash memory, by use of hardware within a tone generation section without using the CPU or a processor within the external storage medium.

It is another object of the present invention to provide an improved tone generation apparatus which has waveform data prestored in an external storage medium, such as a NAND-type flash memory, and reproduces the waveform data while at the same time reading out the waveform data to a waveform memory via a buffer, and which can significantly reduce a burden on a CPU.

It is still another object of the present invention to provide a technique which can perform error detection and correction on the data read out from an external storage medium, such as a NAND-type flash memory, by use of hardware within a tone generation section without using a CPU or a processor within the external storage medium or the like and which can replace an error page, where an error has occurred, with a new page.

In order to accomplish the above-mentioned objects, the present invention provides an improved tone generation apparatus which comprises: an external memory which has a plurality of pages, each page specified by a page address and storing data and error check code for the data therein, the external memory storing a plurality of waveforms as data, each of the waveforms consisting of a series of waveform samples and divided into a plurality of pages of waveform samples in the external memory; a tone generating section which is able to generate a plurality of channels of musical tones simultaneously; and a control section which controls tone generation in the tone generating section in accordance with performance information. The tone generating section comprises: a waveform memory which has a plurality of leading waveform storage areas provided for the plurality of waveforms, and a plurality of buffer areas provided for the plurality of channels, one leading waveform storage area for a waveform storing the waveform samples of a leading page of the waveform, and one buffer area for a channel temporarily storing waveform samples for tone generation of a musical tone of the channel; a control register section which has a plurality of channel areas provided for the plurality of channels, each channel area for a channel storing parameters, for controlling tone generation of a musical tone of the channel, to be set by the control section, the parameters of a channel including: a rate parameter for controlling a pitch of the musical tone; a leading waveform address specifying a leading waveform region in said waveform memory; waveform position information indicative of a position of a waveform in the external memory; and amplitude control information for controlling an amplitude envelope of the musical tone; a readout section which, in response to an activation instruction for each of the channels, first reads out, at a rate corresponding to the rate parameter of the channel, the waveform samples of the leading page from the leading waveform storage area, in the waveform memory, designated by the leading waveform address of the channel, and then repetitively reads out, at the same rate, waveform samples from a buffer area corresponding to the channel in the waveform memory, the readout section capable of reading out waveform samples in the waveform memory for the plurality of channels simultaneously in time division multiplexing manner; a next-address generating section which, for each of the channels, generates, on the basis of the waveform position information of the channel, next page address information designating a page of waveform samples to be read out next from the external memory and sets the generated next page address information of the channel into a next page address storage section; a transfer instruction generation section which, for each of the channels, generates a transfer instruction each time waveform samples readout performed by the readout section for the channel progresses by one page; a transfer queue which, in response to the activation instruction and the transfer instruction of any channel, enqueues thereto a channel number of the channel; a transfer section which dequeues the channel number of a channel from the transfer queue on a first-in-first-out basis, then reads out the waveform samples of the page, designated by the next page address information of the channel set in the next page address storage section, from the external memory in a burst manner, and then writes the read-out waveform samples into the buffer area corresponding to the channel; an error correction section which performs error detection on the waveform samples of the page, read out for the channel from the external memory by the transfer section, using the error correction code of the page and, if an error is detected and correctable, execute correction of the error of the waveform samples; an attenuating section which, when the error is detected on the waveform samples for the channel by the error correction section and not correctable, rapidly attenuates the musical tone of the channel being generated by the tone generating section; and an amplitude control section which, for each of the channels, controls an amplitude envelop of the waveform samples, read out by the readout section, in accordance with the amplitude control information of the channel to thereby generate a musical tone of the channel. When the control section receives performance information for newly starting a musical tone of a pitch, the control section allocates one of the plurality of channels to the musical tone to be newly generated, sets the rate parameter corresponding to the pitch, the leading waveform address, the waveform position information and the amplitude control information into the channel area for the one channel of the control register section and further issues an activation instruction for the channel.

According to the tone generation apparatus of the present invention, page-by-page transfer by the transfer section is performed automatically, in response to an instruction given from the transfer queue, without an interrupt being issued to the control section (CPU). Thus, a burden or load on the control section can be reduced. Further, because readout error detection on the waveform data based on the error correction code and error correction in the case where the detected error is correctable are performed automatically in the tone generation apparatus of the present invention, the tone generation apparatus of the present invention can continue tone generation even when such an error has occurred. Once an uncorrectable error occurs, a tone signal being generated in the channel in question is automatically deadened or silenced. In this way, the control section need not perform various processes related to the external memory, and thus, the burden on the control section can be significantly reduced, so that the control section can perform control with better response.

In an embodiment of the present invention, when any error has been detected by the error correction section, the attenuating section sends, to the control section, an error notice including information identifying a page in the external memory where the error has occurred and information indicating whether the error could be duly corrected. If the error notice indicates that the detected error is a correctable error, the control section records, as an alternative-awaiting page, the information identifying the page where the error has occurred. If the error notice indicates that the detected error is an uncorrectable error, the control section issues a warning indicating that normal tone generation is impossible. Thus, when a correctable error has occurred, the control section records the page where the error has occurred (i.e., error page) and then replaces the error page at appropriate subsequent timing. In this case, an error notice is not immediately sent to the user at the time of the error occurrence, so as not to disturb the user executing a performance. Further, because the error page is replaced, it is possible to lower a probability or possibility with which an uncorrectable data error occurs. If the data error is uncorrectable, on the other hand, a warning is immediately issued to the user to inform that normal tone generation is impossible (i.e., cannot be performed). Further, when a transfer error has occurred, the control section may immediately warn that normal tone generation is impossible. Further, the control section may lower the "total band width" by a predetermined amount (or number), so as to reduce the likelihood of an error occurring.

According to another aspect of the present invention, there is provided an improved tone generation apparatus which comprises: an external memory which has a plurality of pages successively arranged in a virtual address space and stores a plurality of waveforms, each of the waveforms consisting of a series of waveform samples and divided into a plurality of pages of waveform samples, each of the plurality of pages of the external memory being specified by a virtual page address and storing a page of waveform samples; a tone generating section which is able to generate a plurality of channels of musical tones simultaneously; and a control section which controls tone generation in the tone generating section in accordance with performance information. The tone generating section comprising: a waveform memory which has a plurality of leading waveform storage areas provided for the plurality of waveforms, and a plurality of buffer areas provided for the plurality of channels, one leading waveform storage area for a waveform storing the waveform samples of a leading page of the waveform, and one buffer area for a channel temporarily storing waveform samples for tone generation of a musical tone of the channel; an address conversion table provided for converting the virtual page address, identifying a page in the virtual address space, into a real page address; a control register section which has a plurality of channel areas provided for the plurality of channels, each channel area for a channel storing parameters, for controlling tone generation of a musical tone of the channel, to be set by the control section, the parameters of a channel including: a rate parameter for controlling a pitch of the musical tone; a leading waveform address specifying a leading waveform region in the waveform memory; waveform position information indicative of a position of a waveform in the external memory; and amplitude control information for controlling an amplitude envelope of the musical tone; a readout section which, in response to an activation instruction for each of the channels, first reads out, at a rate corresponding to the rate parameter of the channel, the waveform samples of the leading page from the leading waveform storage area, in the waveform memory, designated by the leading waveform address of the channel, and then repetitively reads out, at the same rate, waveform samples from a buffer area corresponding to the channel in the waveform memory, the readout section capable of reading out waveform samples in said waveform memory for the plurality of channels simultaneously in time division multiplexing manner; a next-address generating section which, for each of the channels, generates, on the basis of the waveform position information of the channel, a virtual page address designating a page of waveform samples to be read out next in the virtual address space of the external memory, converts the virtual page address to a real page address by reference to the address conversion table and then sets the converted real page address into a next page address storage section; a transfer instruction generation section which, for each of the channels, generates a transfer instruction each time waveform samples readout performed by the readout section for the channel progresses by one page; a transfer queue which, in response to the activation instruction and the transfer instruction of any channel, enqueues thereto a channel number of the channel; a transfer section which dequeues the channel number of a channel from the transfer queue on a first-in-first-out basis, then reads out the waveform samples of the page designated by next page address information of the channel set in the next page address storage section, from the external memory in a burst manner, and then writes the read-out waveform samples into the buffer area corresponding to the channel; and an amplitude control section which, for each of the channels, controls an amplitude envelop of the waveform samples, read out by the readout section, in accordance with the amplitude control information of the channel to thereby generate a musical tone of the channel. When the control section receives performance information for newly starting a musical tone of a pitch, the control section allocates one of the plurality of channels to the musical tone to be newly generated, sets the rate parameter corresponding to the pitch, the leading waveform address, the waveform position information and the amplitude control information into the channel area for the one channel of the control register section and further issues an activation instruction for the channel. According to the invention, the next-address setting section converts the virtual page address of the page, which is to be read out next, to a real page address, by reference to the address conversion table, to thereby acquire a next page address, and, in response to an instruction of the transfer queue, the transfer section reads out a page from the external memory using the next page address and then transfers the read-out page to the waveform memory. Thus, the page-by-page transfer by the transfer section is performed automatically by hardware without an interrupt being issued to the control section (CPU). Thus, the burden on the control section can be reduced. As an embodiment of the present invention, the address conversion table may be originally stored in the external memory, and, at the time of activation (powering-on) of the tone generation apparatus, the address conversion table may be read out from the external memory and stored into an internal address conversion table storage section.

As an embodiment of the present invention, the tone generation apparatus may further comprise: an error correction section which performs error detection on the waveform samples of the page, read out from the external memory by the transfer section, using error correction code of the page and, if an error is detected and correctable, execute correction of the error of the waveform samples; an attenuating section which, when the error is detected on the waveform samples for the channel by the error correction section and correctable, sends, to the control section, an error notice including information indicating that the correctable error has been detected and identifying a page in the external memory where the error has occurred. In this case, the control section records, as an alternative-awaiting page, the information identifying the page where the correctable error has occurred. If there is any page currently recorded as the alternative-awaiting page, the control section secures, through an automatically-started background process or through a process started in response to a user's instruction, an alternative page in the external memory, reads out waveform samples of the page recorded as the alternative page, performs error correction to obtain appropriate waveform samples if an error has occurred in readout of the waveform samples of the page recorded as the alternative page, and then stores the appropriate waveform samples into the alternative page to thereby replace the page, where the error has occurred, with the alternative page. The control section modifies the address conversion table in such a manner that a real page address of the alternative page can be acquired when a virtual page address of the alternative-awaiting page is to be converted into a real page address. By the provision of the attenuating section and the error correction section, readout error detection on the waveform data and error correction in the case where the detected error is correctable are performed automatically in the tone generation apparatus of the present invention, and thus, the tone generation apparatus of the present invention can continue tone generation even when such an error has occurred. The control section records the page where the error has occurred (i.e., error page) and then replaces the error page at appropriate subsequent timing. In this case, replacement, of the error page, with the alternative page can be done with ease, because correspondency between virtual pages and real pages are defined by the address conversion table.

According to still another aspect of the present invention, there is provided an improved tone generation apparatus which comprises: an external memory which has a plurality of pages successively arranged in a virtual address space and stores a plurality of waveforms, each of the waveforms consisting of a series of waveform samples and divided into a plurality of pages of waveform samples, each of the plurality of pages of the external memory being specified by a virtual page address and storing a page of waveform samples and a real page address of a next page to be read out next; a tone generating section which is able to generate a plurality of channels of musical tones simultaneously; and a control section which controls tone generation in the tone generating section in accordance with performance information, The tone generating section comprises: a waveform memory which has a plurality of leading waveform storage areas provided for the plurality of waveforms, and a plurality of buffer areas provided for the plurality of channels, one leading waveform storage area for a waveform storing the waveform samples of a leading page of the waveform, and one buffer area for a channel temporarily storing waveform samples for tone generation of a musical tone of the channel; a control register section which has a plurality of channel areas provided for the plurality of channels, each channel area for a channel storing parameters, for controlling tone generation of a musical tone of the channel, to be set by the control section, the parameters of a channel including: a rate parameter for controlling a pitch of the musical tone; a leading waveform address specifying a leading waveform region in said waveform memory; and amplitude control information for controlling an amplitude envelope of the musical tone; a readout section which, in response to an activation instruction for each of the channels, first reads out, at a rate corresponding to the rate parameter of the channel, the waveform samples of the leading page from the leading waveform storage area of the waveform memory designated by the leading waveform address, and then repetitively reads out, at the same rate, the waveform samples from the buffer area of the waveform memory corresponding to the channel; a transfer instruction generation section which, for each of the channels, generates a transfer instruction each time waveform samples readout performed by the readout section for the channel progresses by one page; a transfer queue which, in response to the activation instruction and the transfer instruction of any channel, enqueues thereto a channel number of the channel a next page address storage section which, for each of the channels, stores therein a real page address of a page to be read out next from the external memory; a first next page address setting section which, at a time of starting of tone generation in each of the channels, writes, into the next page address storage section, a real page address of a page to be read out first; a transfer section which dequeues the channel number of a channel from the transfer queue on a first-in-first-out basis, then reads out, from the external memory, waveform samples of the page of the real page address, set in the next page address storage section, to be read out next in the channel and then writes the read-out waveform samples into the buffer area of the waveform memory corresponding to the channel indicated by the channel number; a second next page address setting section which, for each of the channels and when the waveform samples of the next page have been read out from the external memory by the transfer section, overwrites a real page address of a next page, included in the read-out page, into the next page address storage section; and an amplitude control section which, for each of the channels, controls an amplitude envelop of the waveform samples, read out by the readout section, in accordance with the amplitude control information to thereby generate a musical tone of the channel. When the control section receives performance information for newly starting a musical tone of a pitch, the control section allocates one of the plurality of channels to the musical tone to be newly generated, sets the rate parameter corresponding to the tone pitch, the leading waveform address and the amplitude control information into the channel area for the one channel of the control register section and further issues an activation instruction for the channel. According to the present invention, the external memory has a plurality of pages successively arranged in a virtual address space, and each page stores a plurality of waveforms and data of a real page address that is a pointer to a page to be read out next (i.e., next page). Thus, a real page address of the page to be read out next can be acquired by following the pointer. Thus, in response to an instruction of the transfer queue, the transfer section reads out a page from the external memory using the next page address and then transfers the read-out page to the waveform memory. Consequently, the page-by-page transfer by the transfer section is performed automatically by hardware without an interrupt being issued to the control section (CPU), so that the burden on the control section can be significantly reduced.

According to an embodiment of the present invention, the tone generation apparatus further comprises: an error correction section which performs error detection on the waveform samples of the page, read out for the channel from the external memory by the transfer section, using an error correction code of the page and, if an error is detected and correctable, execute correction of the error of the waveform samples; an attenuating section which, when the error is detected on the waveform samples for the channel by the error correction section and correctable, sends, to the control section, an error notice including information indicating that the correctable error has been detected and identifying a page in the external memory where the error has occurred. In this case, the control section records, as an alternative-awaiting page, the information identifying the page where the correctable error has occurred. If there is any page currently recorded as the alternative-awaiting page, the control section secures, through an automatically-started background process or through a process started in response to a user's instruction, an alternative page in the external memory, reads out waveform samples of the page recorded as the alternative page, performs error correction to obtain appropriate waveform samples if an error has occurred in the readout of the waveform samples of the page recorded as the alternative page, and then stores the appropriate waveform samples into the alternative page to thereby replace the page, where the error has occurred, with the alternative page. The control section modifies a real page address of a next page, included in a page preceding the alternative-awaiting page, to a real page address of the alternative-awaiting page. By the provision of the attenuating section and the error correction section, readout error detection on the waveform samples and error correction in the case where the detected error is correctable are performed automatically in the tone generation apparatus of the present invention, and thus, the tone generation apparatus of the present invention can continue tone generation even when such an error has occurred. The control section records the page where the error has occurred and then replaces the error page at appropriate subsequent timing. Because adjoining pages are linked by the pointer to a next page, replacement, of the error page, with the alternative page can be done with ease by rewriting of the pointer included in a page preceding the error page.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
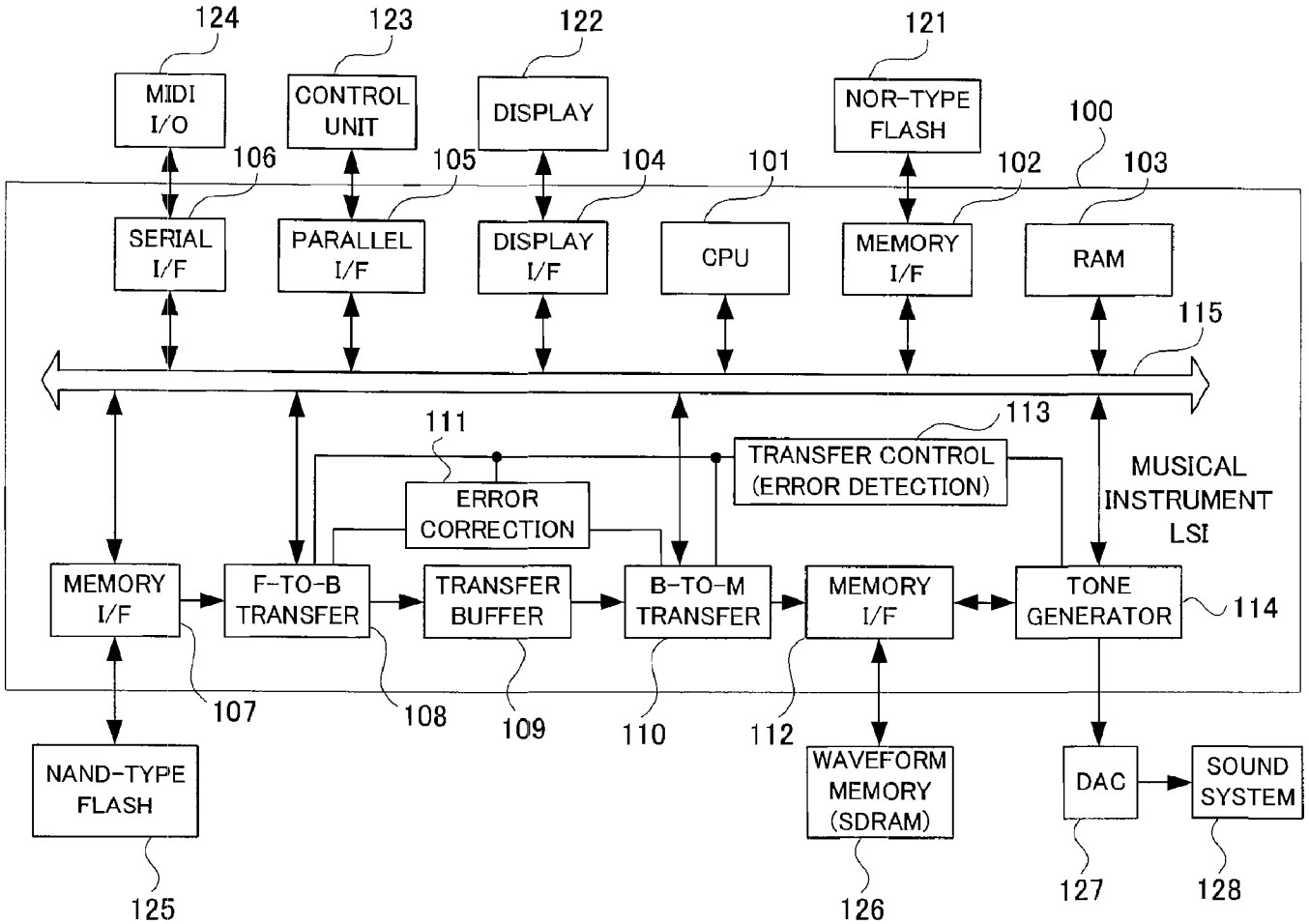
FIG. 1 is a block diagram showing an example general setup of an embodiment of a tone signal generation apparatus (system) of the present invention.

FIG. 1 is a block diagram showing an example general setup of an embodiment of a tone generation apparatus (system) of the present invention. The tone generation apparatus is constructed by connecting predetermined peripheral devices, such as a memory, to a musical instrument or tone generator LSI (Large Scale Integrated circuit) 100.

A CPU 101 is a processing device for controlling entire operation of the tone generation apparatus. A memory I/F (interface) 102 is an interface for connecting a NOR-type flash memory 121 to the musical instrument LSI 100. The NOR-type flash memory 121 is a rewritable, non-volatile memory having stored therein various data, such as programs for execution by the CPU 101 and tone color data. A random access memory (RAM) 103 is a volatile memory for use as various working areas for use by the CPU 101. A display I/F 104, parallel I/F 105 and serial I/F 106 are interfaces for connecting a display device 122, control unit 123 and MIDI I/O 124. The display device 122 displays various information, and the control unit 123 comprises controls, such as various switches, provided on an external panel and the like. The MIDI I/O 124 is an interface for inputting and outputting MIDI signals from and to various MIDI equipment.

A memory interface (I/F) 107 is an interface for accessing a NAND-type flash memory 125 provided as an external memory. The NAND-type flash memory 125 is a rewritable, non-volatile memory having prestored therein a plurality of types of waveform data etc., and data reading and writing from and to the NAND-type flash memory 125 is performed on a page-by-page basis. Namely, NAND-type flash memory (external memory) 125 has a plurality of pages and stores therein data for each page. The data for each page stored in the memory 125 includes a plurality of waveforms each consisting of a series of waveform samples and divided into a plurality of waveform samples in the memory 125. Each page in the memory 125 is specified by a page address to be used for the page-by-page-basis reading and writing. Each of the pages comprises 2,112 bytes. Such page-by-page data readout can be performed at a rapid speed through burst transfer. An example memory map of the NAND-type flash memory 125 will be described in detail later with reference to FIG. 2. A transfer buffer 109 is a buffer memory for transferring waveform data from the NAND-type flash memory 125 to a waveform memory 126, and the transfer buffer 109 is implemented by a dual-port semiconductor memory capable of simultaneously reading and writing data thereon. More specifically, the transfer buffer 109 is in the form of a static RAM (SRAM) having a capacity of one page, i.e. 2,112 bytes. The waveform memory 126 is in the form of a synchronous dynamic RAM (SDRAM), an example memory map of which will be described in detail with reference to FIG. 3. A memory I/F 112 is an interface for accessing the waveform memory 126. Note that the transfer buffer 109 and the waveform memory 126 are capable of random access (i.e., reading and writing in response to designation of individual addresses) at extremely high speed as compared to the flash memory 125. Further, the instant embodiment can perform access to successive addresses at increased speed using a burst mode.

An F-to-B transfer section 108 performs an operation for transferring page data from the NAND-type flash memory 125 to the transfer buffer 109 on a page-by-page basis. A B-to-M transfer buffer 110 performs an operation for transferring waveform data of one page from the transfer buffer 109 to the waveform memory 126 dividedly in three parts. An error correction section 111 performs operations, such as error detection, correction, etc. on the data read out from the flash memory 125. The F-to-B transfer section 108, B-to-M transfer buffer 110 and error correction section 111 operate under control of a transfer control section 113. Timing of the transfer operations will be described in detail later with reference to FIG. 4 and the like The transfer control section 113 controls the transfer from the flash memory 125 to the transfer buffer 109 and from the transfer buffer 109 to the waveform memory 126. When a plurality of transfer requests have occurred, the transfer control section 113 controls the requested transfer so that page-by-page transfer is effected on a first-come-first-served basis, because only one page can be transferred at a time. Note that currently commercially available NAND-type flash memories are each limited in data width to eight bits. Therefore, the F-to-B transfer section 108 connects together and thereby converts two groups of 8-bit data, read out from two successive addresses of the NAND-type flash memory 125, into 16-bit data and then writes the 16-bit data into the transfer buffer 109 having a 16-bit data width. Further, the waveform memory 126 also has a 16-bit data width, so that data of 16 bits are stored in each address of the waveform memory 126. Thus, the B-to-M transfer buffer 110 does not have to perform data conversion as performed by the F-to-B transfer section 108.

A tone generator 114 has a function for generating a waveform in each of a plurality of (128 in this case) tone generating channels (hereinafter also referred to simply as "channels"). For each of the tone generating channels, the tone generator 114 generates a read address, reads out waveform data (waveform sample data) from the waveform memory 126, imparts an envelope to the read-out waveform data and thereby generates a tone signal for the channel. Further, the tone generator 114 mixes together the thus-generated tone signals of the plurality of tone generating channels and imparts effects, such as reverberation, to the resultant mixed tone signal. The tone signal output from the tone generator 114 is converted to an analog audio signal via a digital-to-analog converter (DAC period) 127 and audibly generated or sounded via a sound system 128. Reference numeral 115 represents a combination of a control bus, data bus and address bus interconnecting the various components; namely, these control bus, data bus and address bus will hereinafter collectively referred to as "bus 115".

With reference to FIG. 2, the following describe the memory map of the NAND-type flash memory 125. As known, the NAND-type flash memory is characterized in that, although it takes time to make instant access to a desired page (the term "instant access" is used herein to refer to a time period from a time when a read command and read address are given to the flash memory to a time when data readout is started, or operations performed in such a time period), it is less costly than a mask ROM and can achieve data transfer at high speed (burst transfer) after the start of the data readout. Data readout and write on the NAND-type flash memory 125 is performed on the page-by-page basis.

Of 2112 bytes constituting one page of data (i.e., page data), 2,048 bytes are used as a data area, and 64 bytes are used as an additional information area. The additional information includes error correction code. As the data of 2,048 bytes are written into the data area, error correction code is generated through predetermined arithmetic operations based on the written data and written into the additional information area. As the page data are read out, it is possible to check or determine, by the error correction code written in the additional information area, whether the 2,048-byte data, read out from the data area, have any error or not. If the read-out 2,048-byte data have any error (and if the number of bits of the error is less than a predetermined value), an error correction process can be performed. Note that the error correction code may be generated using generating arithmetic expressions based on any one of the conventionally-known schemes, such as the hamming code scheme and BCH code scheme. Generally, for each of the generating arithmetic expressions, there is determined in advance an error detecting arithmetic expression for calculating a state of an error having occurred (i.e., how many bits the error comprises and whether the error is correctable), and an error correcting arithmetic expression for calculating a bit position to be corrected if the error is correctable. For each of the arithmetic expressions, there is determined in advance up to how many bits of error in $\alpha$-byte data, written in the data area, can be corrected by $\beta$-bit error correction code.

Figure 2A:
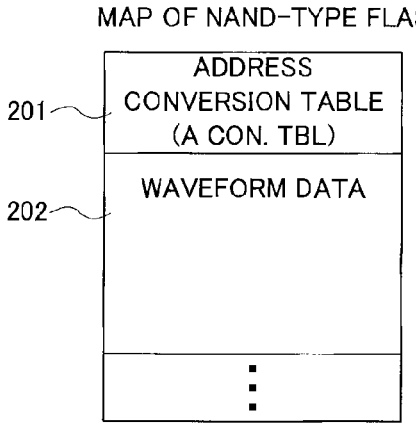
FIGS. 2A to 2E are diagrams showing a memory map of a NAND-type flash memory employed in the embodiment.

FIG. 2A illustratively shows an overall memory map of the NAND-type flash memory 125 employed as the external storage medium in the embodiment. The flash memory 125 includes a plurality of real pages that can be accessed by real page addresses and stores data in these pages. An address conversion table (A CON. TBL) 201 and a plurality of series of waveform data 202 are prestored in the flash memory 125. Let it be assumed here that the address conversion table 201 and the waveform data 202 are prestored dividedly in pages.

Figure 2E:
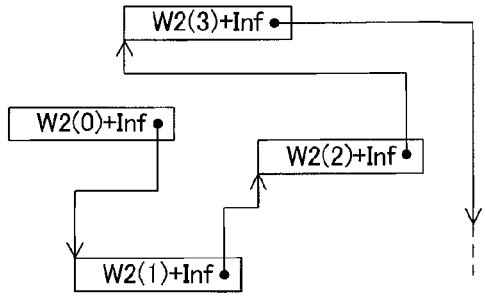
Figure 2B:
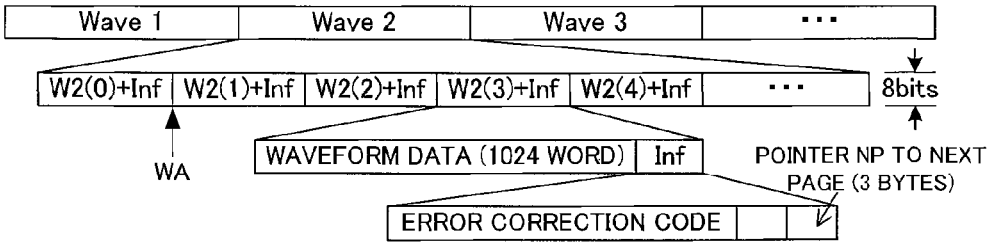

A virtual address space as well as a real address space of the waveform data 202 is set in the flash memory 125 in such a manner that real page addresses and virtual page addresses correspond to each other in one-to-one relationship, as shown in FIGS. 2B and 2E. Each of the real address space and virtual address space is assumed to be a range that can be accessed by page addresses each having 20 (twenty) bits.

FIG. 2B shows a data format in the virtual address space of the waveform data. A plurality of waveform data groups Wave1, Wave2, . . . , are stored in a storage area for the waveform data 202. In each of the waveform data groups, as representatively shown in the figure in relation to the waveform data group Wave2, a plurality of pages W2(0)+Inf, W2(1)+Inf, . . . are stored in association with successive virtual page addresses (i.e., successively arranged in the virtual address space). The data areas of the individual pages stored at successive virtual page addresses of the waveform data groups x (x=1, 2, . . . ), or waveform sample data (each comprising 1,024 words) stored in the data areas are indicated by Wx(0), Wx(1), . . . . Because the data of each page (i.e. each one-page data) comprises a combination of waveform sample data of the data area and additional information (64 bytes) attached thereto, the data of each page is indicated by a combination of the reference mark "Wx" of the data area and "+Inf". As noted above, the additional information includes error correction code. Each of the waveform data groups Wavex is stored dividedly in a plurality of pages successively arranged in the virtual address space. Thus, when the waveform data group Wave2 is to be read out, for example, the virtual page address P of the leading page "W2(0)+inf" only has to be given, because the individual other pages W2(1)+inf, W2(2)+inf, . . . following the leading page W2(0)+inf can be read out with their respective virtual page addresses P+1, P+2, . . . . Although FIG. 2B shows as if there were no empty pages between the waveform data groups Wave1, Wave2, . . . , empty pages may exist between the waveform data groups Wave1, Wave2, . . . . In is only necessary that one series of waveform data (or waveform data set) corresponding to one type of waveform be stored successively in the virtual address space. In FIG. 2B, "WA" indicates one of control registers which is provided for setting therein the virtual page address of the second virtual page "Wx(1)+Inf" of the waveform data set, as will be described in detail later.

The foregoing have described that each page can be read out with a virtual page address. Actually, however, it is necessary to convert each given virtual page address to a real page address so that the corresponding page can be read out from the flash memory 125 with the converted real page address. In the musical instrument LSI 100 of the instant embodiment, any one of two different modes, i.e. Mode 1 and Mode 2, can be designated as a scheme for conversion between a virtual page address and a real page address.

Figure 2C:
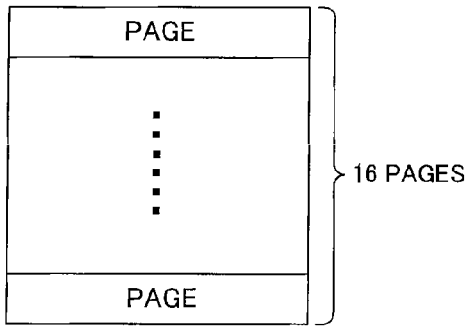

First, Mode 1 is explained hereinbelow. Mode 1 employs a "block" scheme or concept in which 16 (sixteen) successive pages are set as one block, as shown in FIG. 2C. In Mode 1, the storage area for the waveform data set 202 shown in FIG. 2A is divided into a plurality of blocks and used on a block-by-block basis, and, in each of the blocks, waveform data are stored successively in ascending order of real page addresses. For example, when one waveform data group Wave2 is to be stored into the flash memory 125, a particular number of blocks necessary for storing the waveform data group Wave2 are secured in the flash memory 125, so that the leading page W2(0)+inf through to the page W2(15)+inf are sequentially stored into the first block, and the page W2(16)+inf through to the page W2(31)+inf are sequentially stored into the next block, and so on. Let it be assumed that different waveform data groups (e.g., Wave1 and Wave2) are stored into different blocks. Note that the blocks are aligned with one another by being subjected to "boundary alignment" every 16 (sixteen) pages.

Figure 2D:
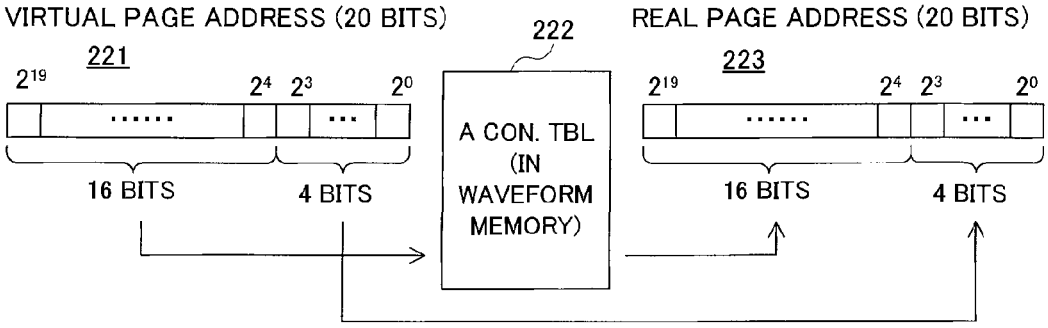

FIG. 2D shows a specific scheme employed in Mode 1 for converting a virtual page address to a real page address. Now assume that a virtual page address (or page number) 221 of 20 bits is given. Upper 16 bits of the virtual page address 221 indicate a virtual block number for identifying a particular block, while lower 4 bits of the virtual page address 221 are data that identifies one of the 16 pages in the block. The virtual block number indicated by the upper 16 bits of the virtual page address 221 is converted into upper 16 bits of a real page address 223. The lower 4 bits of the virtual page address 221 are set directly as lower 4 bits of the real page address 223. The flash memory 125 is accessed with the real page address 223, obtained in the aforementioned manner, so that page data of the virtual page address 221 are read out from the flash memory 125.

At the time of system start-up, the address conversion table 222 is read out from the area 201 of the flash memory 125 and is set into the waveform memory 126 for subsequent use. The area 201 is merely shown as "ADDRESS CON. TBL" in FIG. 2A; actually however, a meaningful address conversion table can be obtained by combining the data stored in the data areas of the plurality of pages of the area 201. Correspondence relationship between all virtual block numbers and real block numbers are registered in advance in the data areas of the plurality of pages constituting the area 201 when waveform data were stored into the flash memory 125. The real page addresses of the plurality of pages of the area 201 are determined in advance. Note that a "pointer NP to a next page" contained in the additional information Inf shown in FIG. 2*b* is data for use in Mode 2 but not needed in Mode 1.

In Mode 2, when a waveform data group is to be stored into the flash memory 125, the "pointer NP to a next page" of three bytes is set into the additional information Inf of each page, as shown in FIG. 2B. In the pointer NP to a next page is set in advance a real page address of the next page (i.e., page in which waveform samples following the page in question are stored) as viewed in progression order of the waveform data. FIG. 2E shows an example data format of pages stored at real page addresses of the data group Wave2 in Mode 2. If only a real page address of the leading virtual page W2(0)+Inf is given, the next virtual page W2(1)+Inf can be accessed by reference to the "pointer NP to a next page" contained in the page data. Then, the other pages can be traced in the aforementioned manner, so that waveform data can be sequentially read out.

For each of Mode 1 and Mode 2, the leading pages Wx(0) of all waveform data groups Wave1, Wave2, . . . are preset into the waveform memory 126 at the time of system start-up, as will be later described. Thus, in Mode 2, pages can be traced, starting with a virtual page address WA of the second virtual page Wx(1)+Inf, using each pointer NP to a next page. Conversion from the first-given virtual page address WA to a real page address is performed using the address conversion table having already been read out to the waveform memory 126. Stated conversely, in the address conversion table, only the second virtual page addresses of the individual waveform data groups Wave1, Wave2, . . . and real page addresses converted from the second virtual page addresses have to be prestored in association with each other. The address conversion table in Mode 1, described above in relation to FIG. 2D, is a table that, once a 16-bit virtual block number is given as an address, outputs a real block number of 16 bits stored in that address. In mode 2, on the other hand, the address conversion table is a table that, once the 20-bit second virtual page addresses of the waveform data groups Wave1, Wave2, . . . are given, searches for second virtual page addresses matching the given second virtual page addresses from among second virtual page addresses stored in the address conversion table, and that, if such matching second virtual page addresses are successfully found, outputs the 20-bit real second real page addresses associated with the second virtual page addresses. In the area 201 of FIG. 2A, all correspondence relationship between the second virtual page addresses and the real page addresses is registered in advance as the waveform data are prestored into the flash memory 125.

For each of Mode 1 and Mode 2, any one waveform is stored in a plurality of pages successively arranged in the virtual page address space (i.e., stored at successive virtual page addresses), and thus, it is not necessary to designate each page that should be read out; namely, it is only necessary to designate, at the start of waveform data readout, the first virtual page address of the waveform data set. Let it be assumed that the NAND-type flash memory 125 is constructed to read or write data with an 8-bit width as a read or write unit.

Figure 3A:
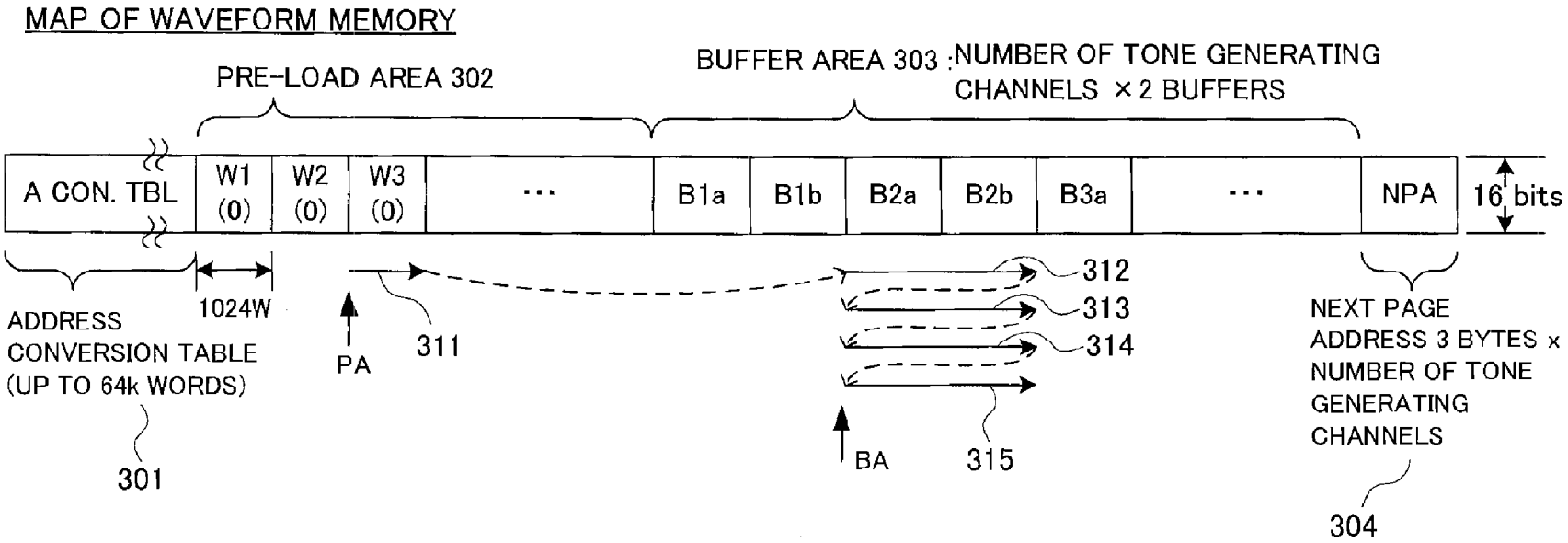
FIGS. 3A and 3B are diagrams illustratively showing a memory map of a waveform memory employed in the embodiment.
Figure 3B:
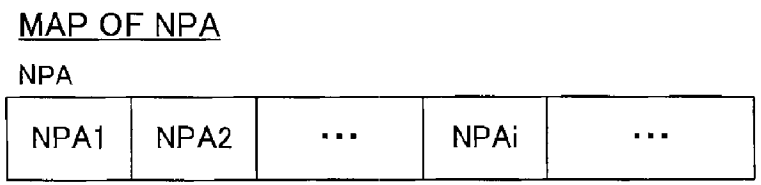

FIGS. 3A and 3B illustratively show the memory map of the waveform memory 126. The waveform memory 126 includes an address conversion table area 301, a pre-load area (leading waveform storage area) 302, buffer area 303 and a next page address (NPA) area 304. The address conversion table area 301 is an area for setting therein the address conversion table read out from the predetermined area 201 of the flash memory 125 of FIG. 2A. The pre-load area 302 is an area for storing therein waveform data W1(0), W2(0), W3(0), . . . of the respective leading pages of the waveform data groups Wave1, Wave2, Wave3, . . . stored in the NAND-type flash memory 125. The waveform data of the respective leading pages are stored into the pre-load area 302 at the time of system start-up. The buffer area 303 includes two buffer regions per tone generating channel; namely, the total number of the buffer regions is equal to the number of the tone generating channels×2. Each of the buffer regions in the buffer area 303 has a capacity or size of one page=1,024 words. The buffer regions corresponding to the tone generating channels i=1, 2, . . . , 128) are indicated by Bia and Bib. The buffer regions Bia and Bib are positioned successively within an address space of the waveform memory 126.

Herein, the terms "page" and "page data" are used in connection with the flash memory 125 and transfer buffer 109 to refer to a page of 2,112 bytes, including additional information Inf, and data contained in the page, but used in connection with the waveform memory 126 to refer to a data area of 1,024 words, including no additional information Inf, and waveform data contained in the data area. In short, the term "page" used in connection with the flash memory 125 and transfer buffer 109 is considered focusing on a data unit to be read out or written, and, when the data are read out from the flash memory 125, subjected to error correction and then set into the waveform memory 126, the term "page" is considered as waveform sample data of 1,024 words.

At the time of system start-up, the setting of the address conversion table into the address conversion table area 301 of the waveform memory 126 and the setting of the respective leading pages Wx(0) of the waveform data groups into the pre-load area 302 are performed mainly through an initial setting process by the transfer control section 113. In order to facilitate the initial setting process on the pre-load area 302, the respective leading pages Wx(0) of the waveform data groups may be stored together in predetermined successive real page address regions of the flash memory 125.

In FIG. 3A, reference character "PA" indicates a register for setting a read address of the leading page, contained in the pre-load area 302, which is to be first read out when the tone generator 114 reads out waveform samples from the waveform memory 126. FIG. 3A shows a case where reproduction of the waveform data group Wave3 in the second channel has been instructed and where the waveform data W3(0) of the leading page in the waveform memory 126 has been designated by the register PA. Arrow 311 indicates an advancing direction of read addresses (pitch counter) with which the tone generator 114 reads out the waveform samples of the leading page. Further, "BA" indicates a register for setting a read address indicating which of the buffers of the buffer area 303 the waveform samples should be read out from after completion of the readout of the leading page from the pre-load area 302. Because waveform data reproduction in the second channel has been instructed in the illustrated example, a leading address of the buffer B2*a* or B2*b* for use by the second channel are set into the register BA. Arrow 312 indicates an advancing direction of read addresses (pitch counter). After the waveform samples of the buffer B2*a* and B2*b* have been read as indicated by arrows 312, the readout operation returns back to the leading end of the buffers B2*a* or B2*b* to continue reading out the waveform samples as indicated by arrows 313 and 314. In order to perform such reading of the waveform memory, the waveform sample reproduction is continued by the buffers B2*a* and B2*b* being alternately used such that waveform sample data to be read out next are stored into the buffer B2*a* while the waveform data group Wave3 is being read out from the pre-load area 302, waveform sample data are stored into the buffer B2*b* while waveform sample data are being read out from the buffer B2*a*, then waveform sample data are stored into the buffer B2*a* while waveform sample data are being read out from the buffer B2*b*, and so on. Note that, as an alternative, three buffers rather than two buffers may be provided per channel. Also, let it be assumed that the waveform memory 126 is constructed to read and write data with a 16-bit width as a read or write unit.

The next page address (NPA) area 304 is an area for storing therein a next page address of each of the tone generating channels. FIG. 3B shows an example memory map of the NPA area 304. NPAi indicates the next page address of an i-th channel. More specifically, the next page address NPAi is a real page address of a page of the flash memory 125 which is to be read out from the flash memory 125 to the waveform memory 126. Setting timing and setting data of the next page address NPAi will be described in detail later.

Figure 4:
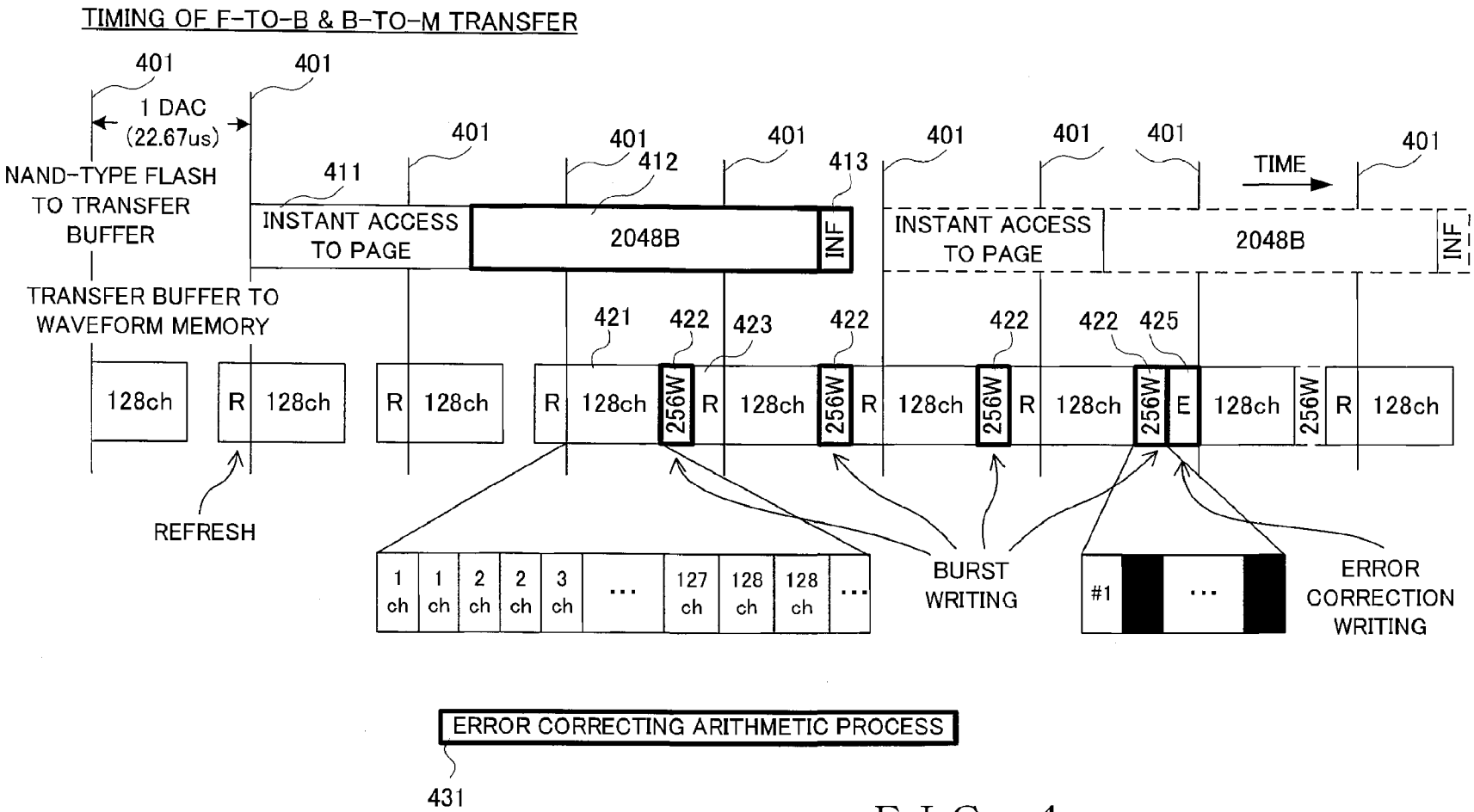
FIG. 4 is a time chart explanatory of timing of waveform data transfer performed in the embodiment.

FIG. 4 is a time chart explanatory of timing of waveform data transfer performed by the transfer sections 108 and 110 under the control of the transfer control section 113, where the time passes in a direction of arrow t. A plurality of vertical lines 401 each indicate sampling clock generation timing, and a time section between each pair of the adjoining vertical lines 401 indicates one sampling period (hereinafter referred to as "one DAC period"). In the instant embodiment, one DAC period is 22.67 nsec. "NAND-TYPE FLASH to TRANSFER BUFFER" in FIG. 4 indicates a time chart of a process performed by the F-to-B transfer section 108 for transferring waveform samples of one page (i.e., one-page data) and additional information to the transfer buffer 109. "TRANSFER BUFFER to WAVEFORM MEMORY" in FIG. 4 indicates a time chart of a process performed by the B-to-M transfer section 110 for transferring waveform samples of one page (i.e., one-page data) from the transfer buffer 109 to the buffer area 303 (i.e., buffers corresponding to the channel in question) of the waveform memory 126, as well as a process performed by the tone generator 114 for reading out waveform samples from the waveform memory 126.

Reference numeral 411 in FIG. 4 indicates an instant-access-to-page time section (or period) from a time when real page address supply to the NAND-type flash memory 125 is started to a time when preparation for outputting data of the page indicated or designated by the real page address is completed in the flash memory 125. After completion of the instant access to the page as indicated by 411, the data (2,048 bytes of the data area and additional information Inf) of the page are read out (burst-transferred). In the instant embodiment, the data and additional information Inf of one page can be read out from the NAND-type flash memory 125 and written into the transfer buffer 109 in four DAC periods, as indicated at 411 to 413. The transfer time of four DAC periods is determined on the basis of the specification of the NAND-type flash memory 125 regarding page readout (burst transfer).

Reference numeral 421 in FIG. 4 indicates a waveform sample readout time section (or period) when the tone generator 114 reads out waveform samples of 128 channels from the waveform memory 126 for generation of tones. 422 indicates a burst transfer time section when waveform samples of one page (i.e., one-page data) of the data area of the transfer buffer 109 are transferred to the corresponding channel buffer of the waveform memory 126. Such transfer is data transfer from an internal register of the musical instrument LSI 100 to the DRAM and performed at high speed in the burst mode. 423 indicates a refreshing time section when the waveform memory 126 is refreshed. The refreshing time section 423 has a time length determined by the specification of the waveform memory 126. The time section of one DAC period with the time section of the refreshing 423 excluded therefrom is shared between the waveform sample readout time section 421 and the burst transfer time section 422.

The waveform sample readout time section 421 in one DAC period has a time length that is determined by a human designer on the basis of the requested specifications as to for many channels tone generation is performed in the embodiment of the tone generation apparatus and as to between how many points interpolation is performed in each of the channels and on the basis of the specification as to with what time resolution and how many waveform samples of each of the channels the tone generator 114 can read out from the waveform memory 126 in the one DAC period on a time-divisional basis. The burst transfer time section 422 in the one DAC period has a time length that is determined by a human designer on the basis of the requested specification as to how many waveform samples should be transferred in this time section and on the basis of the specification regarding the speed of the burst transfer from the transfer buffer 109 to the waveform memory 126. The transfer buffer 109 is a memory capable of simultaneously performing read and write thereon and has a capacity or size of waveform sample data of one page plus additional information. Thus, basically, the waveform samples of one page (2,048 bytes) read out from the flash memory 125 to the transfer buffer 109 have to be transferred from the transfer buffer 109 to the waveform memory 126 in the same number of DAC periods as in the page read out from the flash memory 125 to the transfer buffer 109. Therefore, in one burst transfer time section 422, it is necessary to transfer a given number (number truncated after the decimal point) of samples calculated by dividing the number of samples of one page by the number of DAC periods. In the instant embodiment, where four DAC periods are required to read out data of one page (2,048 bytes=1,024 samples) from the one-page data area of the flash memory 125 to the transfer buffer 109, transferring of the waveform samples of one page, read out to the transfer buffer 109, to the waveform memory 126 is also performed in four DAC periods. Thus, 256 samples, which is one-fourth of the data of one page, are transferred in one burst transfer time section 422.

Let it be assumed here that two-point interpolation is performed in each of the channels and tone generation is performed in a total of 128 channels, and that the waveform sample readout time section 421 has a time length necessary for permitting such tone generation in the 128 channels. Also let's assume that there is employed hardware capable of burst-transferring 256 samples (words) in the time section 422 that is the remainder of the one DAC period with the waveform sample readout time section 421 and refreshing time section 423 excluded therefrom.

The following describe an error correction process performed by the error correction section 111. The data transfer from the flash memory 125 to the transfer buffer 109 in time sections 412 and 413 is performed by the F-to-B transfer section 108, as noted above. During such data transfer, the error correction section 111 analyzes the transferred data and performs an error correcting process. 431 indicates a time section when the error correcting arithmetic process is performed. The error correcting process calculates error correction code by performing predetermined arithmetic operations on the data being transferred, compares the calculated error correction code and the error correction code recorded in the additional information Inf to thereby detect an error, determines whether or not the detected error is correctable, and, if the error is correctable, identifies a bit position where the error has been detected. Because the error detecting operation can be performed sequentially immediately following the start of the data transfer from the flash memory 125 to the transfer buffer 109 in the time section 412, the error correcting arithmetic process 431 is started immediately following the start of the data transfer in the time section 412. The error correction section 111 calculates error correction code by executing the error detecting operation in the error correcting arithmetic process time section 431 as the data transfer 412 progresses. Upon completion of the transfer 413, the error correction section 111 performs predetermined error determining arithmetic operations on the basis of the calculated error correction code and the error correction code recorded in the additional information Inf to determine presence or absence of an error, determines whether an error, if any, is correctable, and ultimately determines a to-be-correction position of the error if the error is correctable. Meanwhile, irrespective of presence or absence of an error, the B-to-M transfer section 110 writes 1,024 samples of the transfer buffer 109 into the waveform memory 126 in four transfer time sections 422. If an error has been detected and a to-be-corrected position of the error has been acquired on the basis of the result of the error correcting arithmetic process 431, the error correction section 111 performs error correction on the corresponding waveform data of the waveform memory 126 in a time section 425. Here, an object of error correction is data of 2,048 bytes of the data area in the case of Mode 1, and data of 2,048 bytes of the data area and the pointer NP to a next page in the case of Mode 2. Namely, let it be assumed that, in the case of Mode 2, error correction code for such a data area and pointer NP to a next page is stored per page.

The burst transfer from the transfer buffer 109 to the waveform memory 126 is started in a DAC period two DAC periods later than the start of the transfer from the NAND-type flash memory 125 to the transfer buffer 109. The reason for the two-DAC-period delay is to allow one-page data of 2,048 bytes (=1,024 samples), indicated at 412, to be transferred dividedly in four different time sections, 256 samples per time section, by a burst transfer indicated at 422; namely, the two-DAC-period delay is employed in such a manner that, for each of the four burst transfer 422, 256 sample data to be burst-transferred can be completely transferred from the NAND-type flash memory 125 to the transfer buffer 109 before starting of the burst transfer of the 256 sample data. Therefore, the transfer buffer 109 need not necessarily be of the dual-port type as noted above and may be of a type alternately switching between the read operation and the write operation by use of two RAMs. However, in the instant embodiment, the transfer buffer 109 is implemented by a two-port RAM, in order to perform the read operation and the write operation in a safe and secure manner.

Figure 5:
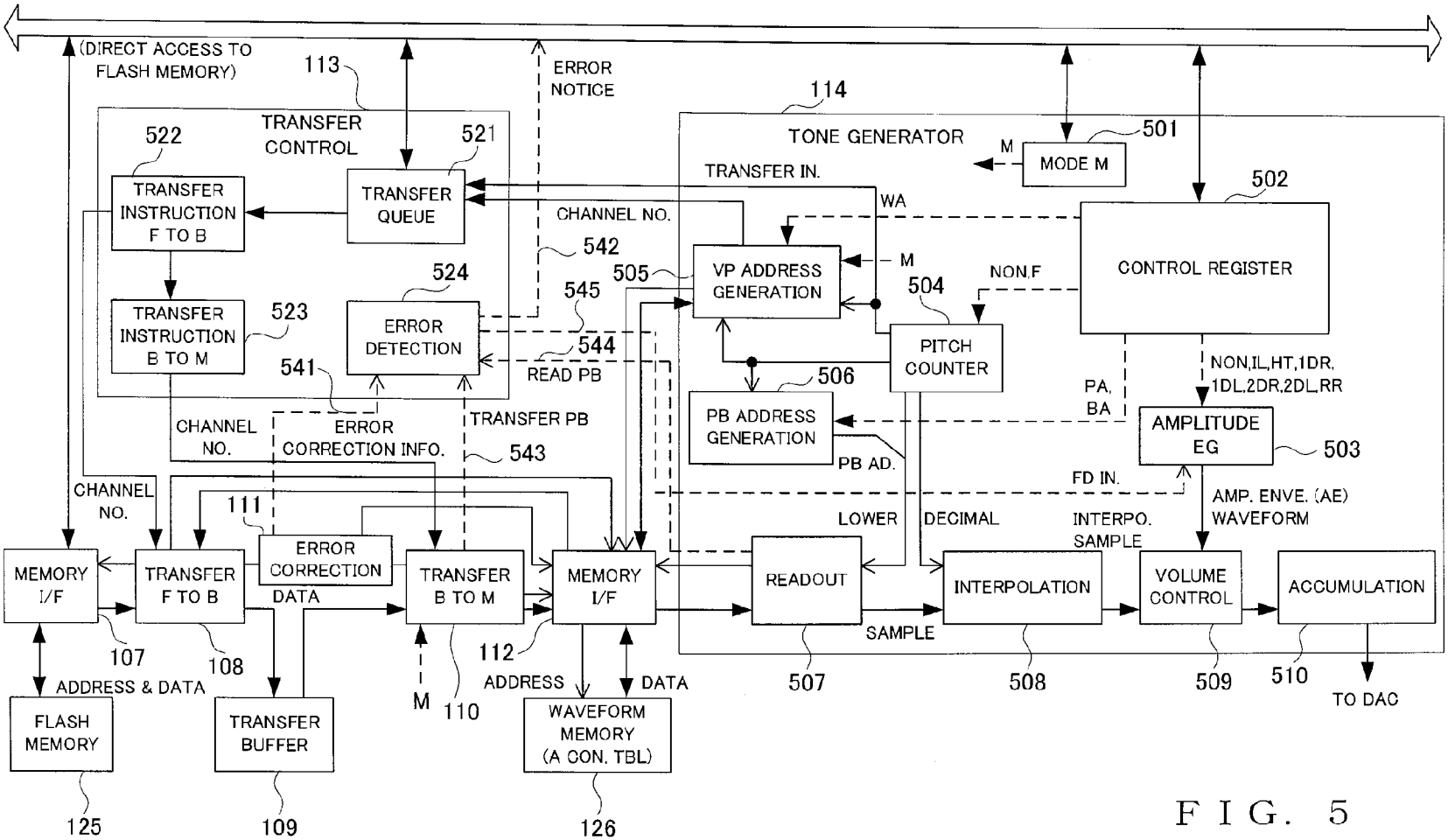
FIG. 5 is a block diagram showing details of a tone generator and transfer control section employed in the embodiment.

FIG. 5 is a block diagram showing details of the tone generator 114 and transfer control section 113, in which input and output of addresses is indicated by ordinary arrows while input and output of other data than addresses is indicated by arrows with a solid black triangular head.

The tone generator 114 includes a mode register 501 for setting therein mode information M designating either Mode 1 or Mode 2 defining a scheme for converting a virtual page address to a real page address. In which of Mode 1 and Mode 2 the instant musical instrument LSI 100 should operate is determined in advance by a human designer. Further, address conversion tables and waveform data are prestored in the flash memory 125 in data formats corresponding to the mode. The mode information is set into the mode register 501 at the time of system start-up.

The tone generator 114 includes a control register (tone generator register) section 502 for storing therein parameters and Note-ON event data NON of the individual channels. Upon receipt of a tone generation instruction, for example, via the MIDI I/O 124, the CPU 101 allocates one of the tone generating channels to the tone generation, sets parameters, based on performance information, into the control register section 502 and writes Note-ON event data into the control register section 502. Thus, the tone generator 114 starts a tone generation process in the allocated tone generating channel. The tone generation instruction corresponds to an activation instruction for the allocated channel. Various registers included in the control register section 502 will be described hereinbelow.

(1) WA: This is a register for setting therein a virtual page address, in the NAND-type flash memory 125 explained above in relation to FIG. 2B, of the second page Wx(1)+Inf of a waveform data group Wavex to be read out from the NAND-type flash memory 125 for the allocated channel.

(2) PA: This is a register for setting therein an address, in the pre-load area 302 of the waveform memory 126 explained above in relation to FIG. 3A, of the leading page Wx(0) of a waveform data group Wavex to be read out from the pre-load area 302 for the allocated channel. At the time of system start-up, the leading pages W1(0), W2(0), . . . of all waveform data groups Wavex are stored from the flash memory 125 into the pre-load area 302 of the waveform memory 126.

(3) BA: This is a register for setting therein addresses, in the buffer area 303 of the waveform memory 126 explained above in relation to FIG. 3A, of the pair of buffers Bna and Bnb corresponding to the allocated channel.

(4) F: This is a register for setting therein an F number. The F number is a parameter that has an integral part and a decimal part and is used to shift (or control) a pitch of waveform data to be read out, and a value of the F number is determined in accordance with a pitch of a musical tone to be generated. More specifically, the F number is set at a value "1" if the pitch of the waveform data need not be shifted, set at a value greater than "1" if the pitch of the waveform data is to be raised (pitch-up), and set at a value lower than "1" if the pitch of the waveform data is to be lowered (pitch-down). The F number is a frequency number or rate information corresponding to a pitch of a tone to be generated.

(5) IL, HT, 1DR, 1DL, 2DR, 2DL and RR: These are registers for setting therein parameters intended to control an amplitude envelope of a musical tone. IL indicates an initial level, and HT indicates a hold time. These are parameters instructing that the initial level IL should continue to be output in a fixed manner as an amplitude envelope waveform for a period of the hold time HT from the start of tone generation. Each waveform data set prepared in the NAND-type flash memory 125 is a data set that may achieve, for an attack portion thereof, a more realistic tone if tone volume variation present in an original sampled waveform is used as-is. Thus, for the time section of the hold time HT corresponding to the attack portion, the initial level IL is set as an envelope waveform. 1DR indicates a first decay rate, and 1DL indicates a first decay level. These are parameters intended to output an envelope waveform that, after elapse of the hold time HT, reaches a target value of the first decay level 1DL at a variation rate indicated by the first decay rate IDR. Similarly, 2DR indicates a second decay rate, and 2DL indicates a second decay level. These are parameters intended to output an envelope waveform that, after the first decay, reaches a target value of the second decay level 2DL at a variation rate indicated by the second decay rate 2DR. Upon occurrence of a Note-OFF event following the second decay, the tone volume level is gradually lowered at a variation rate indicated by the release rate RR. The tone is silenced or deadened once the tone volume level lowers below a predetermined level.

(6) NON: This is a register for setting therein Note-ON event data instructing that generation of a musical tone be started.

Once the CPU 101 sets the above-mentioned parameters, including the Note-ON event, into the control register section 502 corresponding to a given channel, the tone generator 114 starts the tone generation process in the channel. Note that various parameters shown within a block of the tone generator 114 of FIG. 5 are those of the channel being processed at a particular time point. Namely, the parameters vary in value as the channel to be processed changes.

The following describe processing performed on one channel in the individual blocks or components, such as the tone generator 114. Similar processing is performed, per DAC period (sampling period), on all of the 128 channels on a time-divisional basis, so that a plurality of tones are generated in parallel. Namely, reading out waveform samples in the waveform memory 126 for the plurality of channels is performed simultaneously in time division multiplexing manner.

Note-ON event NON and F number are input to the pitch counter 504. The pitch counter 504 is reset to zero in response to the Note-ON event and then accumulates an F number every DAC period (sampling period). A resultant accumulated value is output from the pitch counter 504 as a combination of an integral part and decimal part. Data indicative of the integral part of the accumulated value with lower ten bits excluded therefrom (hereinafter referred to as "integral part's upper bits") are input to a VP (i.e., Virtual Page) address generation section 505 and PB address generation section 506. The lower ten bits of the integral part of the accumulated value (hereinafter referred to as "integral part's lower ten bits") are input to a readout section 507. The decimal part of the accumulated value is input to an interpolation section 508. At predetermined timing, the pitch counter 504 outputs a transfer instruction signal to the VP address section 505 and transfer queue 521. Variation over time of the above-mentioned integral part and decimal part, transfer instruction timing, etc. will be described in detail later with reference to FIG. 6. The pitch counter 504 continues the F number accumulation even after a Note-OFF event, but discontinues the F number accumulation once the tone generation process of the channel in question is terminated.

The PB address generation section 506 inputs thereto the address PA (also referred to as "PA address") (address of the leading page in the pre-load area 302 of the waveform memory 126 which is to be read out immediately following the start of tone generation (see FIG. 3A)) and the address BA (also referred to as "BA address") (address of the buffer, corresponding to the channel in question, stored in the waveform memory 126 explained above in relation to FIG. 3A) explained above at (2) and (3) in relation to the control register section 502, and then, the PB address generation section 506 outputs a PB address to the readout section 507. The PB address is an upper address for designating the head of an area to be read out of the waveform memory 126; in effect, however, because the PB address is only an upper address portion, an address obtained by ten-bit 0s (zeros) to the lower end of the PB address is made an absolute address for designating the head of the area to be read out of the waveform memory 126. More specifically, the PB address generation section 506 outputs the PA address as the PB address immediately following the start of tone generation; outputs the BA address as the PB address upon completion of reading of waveform sample data of the leading page of the pre-load area 302 of the waveform memory 126 designated by the PA address; and outputs BA+1 as the PB address upon completion of reading of waveform sample data of the buffer Bia ("i" is a channel number), corresponding to the channel in question and designated by the BA address, of the buffer area 303 of the waveform memory 126 (BA+1 indicates the buffer Bib because the BA address is an upper address portion with lower ten bits excluded therefrom as noted above). Further, the PB address generation section 506 again outputs the BA address as the PB address upon completion of reading of waveform sample data of the buffer Bib, corresponding to the channel in question and designated by the BA+1 address, of the buffer area 303 of the waveform memory 126, and thereafter alternately outputs the BA address and the BA+1 address as the PB address in such a manner that the buffer Bia and the buffer Bib are read alternately. A read address (i.e., absolute address) is generated by adding the integral part's lower ten bits, output from the pitch counter 504, to the lower end of such a PB address. The readout section 507 reads out waveform sample data of the channel in question from the waveform memory 126 via the memory I/F 112, using the thus-generated read address. Let it be assumed here that two waveform samples, i.e. the waveform sample designated by the read address and the next waveform samples, are read out at a time. Note that the waveform memory 126 has a unit data length of one word and one sample of waveform data is stored at each address of the waveform memory 126.

Every DAC period, the interpolation section 508 performs two-point interpolation between the read-out two samples in accordance with a decimal part address output from the pitch counter 504, to thereby calculate one interpolated sample. An interpolated sample "0" is output for each channel where the tone generation process has been terminated.

An amplitude envelope generator (EG) 503 generates an amplitude envelope (AE) waveform on the basis of envelope waveform generating parameters of the channel in question, and it outputs the thus-generated amplitude envelope (AE) waveform to a tone volume control section 509. Every DAC period, the tone volume control section 509 controls the amplitude of an interpolated sample on the basis of a value of the AE waveform and outputs the amplitude-controlled sample as a tone sample of the channel in question. Every DAC period, an accumulation section 510 accumulates the tone samples of the individual channels to thereby output a mixed tone sample of all of the channels. Note that the tone sample may be output after being imparted with effects, such as reverberation.

The integral part's upper bits output from the pitch counter 504 are input to the VP (Virtual Page) address generation section 505 and PB address generation section 506. To the VP address generation section 505 is input the second virtual page address WA, in the NAND-type flash memory 125, of waveform data being read out from the NAND-type flash memory 125 for the channel in question (see FIG. 2B). The VP address generation section 505 generates a VP address on the basis of the input data. The VP address is a virtual page address designating a page of the waveform data to be next read out from the NAND-type flash memory 125 for the channel in question. Because the page to be read out from the flash memory 125 while the tone generator 114 is reading out waveform samples from a page, designated by the PA address, of the pre-load area 302 of the waveform memory 126 immediately following a Note-ON event is a page, designated by the virtual page address WA, of the flash memory 125, the VP address at this time point is the virtual page address WA. Further, because the waveform data are stored in pages successively arranged in the virtual address space as explained above in relation to FIG. 2, the VP address thereafter varies like WA+1, WA+2, WA+3, . . . as will be described in detail later with reference to FIG. 6.

Further, in the case of Mode 1, each time a transfer instruction is input, the VP address generation section 505 accesses the address conversion table area 301 of the waveform memory 126, via the memory I/F 112, to thereby obtain a real page address corresponding to a current VP address and then writes the thus-obtained real page address into a next page address region NPAi provided in the waveform memory 126 for the channel in question. Thus, in Mode 1, the VP address generation section 505 functions as a "next page address generating section". In the case of Mode 2, the VP address generation section 505 accesses the address conversion table area 301 as in Mode 1, in response to a first-given VP address (whose value is equal to the stored value of the control register WA corresponding to a first-given transfer instruction), to thereby obtain a real page address corresponding to the VP address and then writes the thus-obtained real page address into the next page address region NPAi provided in the waveform memory 126 for the channel in question. In Mode 2, setting of the next page address region NPAi for that channel in the case where the VP address thereafter varies like WA+1, WA+2, WA+3, . . . is performed by the B-to-M transfer buffer 110 and thus is not performed by the VP address generation section 505. Therefore, in Mode 2 (except for first-activated Mode 2), the B-to-M transfer buffer 110 functions as the "next page address generating section". Address variation set in the NPA region of the waveform memory 126 will be described in detail later with reference to FIG. 6 etc. In this case, the pitch counter 504 functions as a transfer instruction generation section.

The transfer queue 521 is a first-in-first-out queue. Once a transfer instruction is output from the pitch counter 504, the transfer queue 521 acquires a channel number output from the VP address generation section 505 and registers therein the acquired channel number. Namely, in response to the activation instruction and the transfer instruction of any channel, the transfer queue 521 enqueues thereto the channel number of the channel. Timing of queuing will be described in detail later with reference to FIG. 6. In short, the channel number thus registered in the transfer queue 521 means that, for the channel of the registered channel number, page data of the real page address set in the region NPAi provided in the waveform memory 126 for the channel must have been transferred from the NAND-type flash memory 125 to the waveform memory 126 via the transfer buffer 109 before completion of readout of page data being read out and reproduced from the waveform memory 126 at that time. The transfer by the F-to-B transfer section 108 and the transfer by the B-to-M transfer section 110, explained above in relation to FIG. 4, are executed in response to channel numbers sequentially output from the transfer queue 521; namely, the channel numbers each functions as a trigger for these transfer. Namely, the transfer section (108, 110) dequeues the channel number of a channel from the transfer queue 521 on a first-in-first-out basis. In a case where a plurality of channel numbers are registered in the transfer queue 521, the registered channel numbers are sequentially output from the transfer queue 521 on the first-in-first-out basis, i.e. in the same order they were registered in the transfer queue 521. In response to the output from the transfer queue 521, the transfer by the F-to-B transfer section 108 and the transfer by the B-to-M transfer section 110 each execute the transfer corresponding to the output channel numbers.

When no page data transfer from the NAND-type flash memory 125 to the transfer buffer 109 is being executed, an F-to-B transfer instruction section 522 acquires a channel number i from the transfer queue 521 and sends the acquired channel number i to the F-to-B transfer section 108 and instructs the F-to-B transfer section 108 to transfer page data to be next read out of the NAND-type flash memory 125 to the transfer buffer 109. In response to such a transfer instruction from the F-to-B transfer instruction section 522, the F-to-B transfer section 108 reads out the next page address NPAi, in the waveform memory 126, of the channel number of via the memory I/F 112 and outputs a readout instruction, designating the next page address NPAi, to the flash memory 125. In response to the readout instruction, one-page data (2,112 bytes) are burst-transferred from the flash memory 125, so that the F-to-B transfer section 108 writes the transferred data into the transfer buffer 109. In this manner, one-page data transfer is performed as explained above in the time chart of "NAND-type Flash Memory to Transfer Buffer" of FIG. 4 (reference numerals 411 to 413).

As the F-to-B transfer instruction section 522 outputs the transfer instruction to the F-to-B transfer section 108, it also outputs, to a B-to-M transfer instruction section 523, the transfer instruction and channel number. In response to such a transfer instruction, the B-to-M transfer instruction section 523 outputs the channel number and transfer instruction to the B-to-M transfer section 110 and controls the B-to-M transfer section 110 to burst-transfer the page data (2,048 bytes of the data area) of the transfer buffer 109 to the buffer, corresponding to the channel in question, of the waveform memory 126. Upon receipt of the channel number and transfer instruction from the B-to-M transfer instruction section 523, the B-to-M transfer section 110 outputs a readout instruction, designating the address of the page data, to the transfer section 109 in one DAC period, two DAC periods later than the timing of the transfer instruction, following an access period (421 in FIG. 4) to the waveform memory 126 by the tone generator 114. Thus, first 256 words of the page data are burst-transferred from the transfer section 109, so that the B-to-M transfer section 110 writes the burst-transferred data into the buffer region, corresponding to the channel in question, in the waveform memory 126, as shown at 422 of FIG. 4. Further, succeeding data of 256 words×three blocks too are burst-transferred and written into the buffer region, corresponding to the channel in question, provided in the waveform memory 126 under control of the B-to-M transfer section 110 and using succeeding three DAC periods. In the aforementioned manner, the burst transfer from the transfer section 109 to the waveform memory 126 is performed as explained in the time chart of "Transfer Buffer to Waveform Memory" of FIG. 4 (indicated at reference numeral 422). In Mode 2, the B-to-M transfer section 110 writes the "pointer NP to a next page", included in data being burst-transferred, into the region NPAi provided in the waveform memory 126 for the channel chi in question. The writing into the region NPAi is performed at timing of the time section 425 of FIG. 4 (but before error correction writing is executed).

Before transferring 256 words into the buffer region, corresponding to the channel in question, of the waveform memory 126 through the burst transfer from the transfer buffer 109 to the waveform memory 126, it is necessary to determine to which of the two buffers Bia and Bib the 256 words should be transferred. In the instant embodiment of the tone generation apparatus (system), waveform samples must have been read out by the tone generator 114 from the pre-load area 302 or any of the buffers Bia and Bib for the channel in question, and thus, the buffer Bib is determined to be a burst transfer destination if the samples have been read from the pre-load area 302 or the buffer Bia, or the buffer Bia is determined to be a burst transfer destination if the samples have been read from the pre-load area 302 or the buffer Bib.

When the aforementioned transfer from the NAND-type flash memory to the transfer buffer is being executed, the error correction section 111 analyzes the transferred data and performs the error correcting arithmetic process indicated at 431 of FIG. 4. Upon completion of the transfer 413 of the additional information Inf, the error correction section 111 detects presence or absence of occurrence of an error pertaining to the transferred data, correctability of an error if such an error is detected, and a to-be-corrected position of the error if the error is correctable. If an error is detected, if the detected error is correctable and when a to-be-corrected position of the error has been calculated, the error correction section 111 issues, at the time section 425, an instruction for correcting the to-be-corrected position in the waveform memory via the memory I/F 112, to thereby execute the error correction. In Mode 2, the NPAi too becomes an object of error correction, and thus, the NPAi may sometime be corrected by the error correction operation by the error correction section 111.

The error correction section 111 outputs, to an error detection section 524, error correction information indicating that a correctable error has occurred and hence has been detected, as indicated by a dotted-line arrow 541. Also, if an error has occurred and has been detected and the detected error is uncorrectable, the error correction section 111 outputs, to the error detection section 524, error correction information indicating that an uncorrectable error has occurred, as indicated by the broken line arrow 541. Let it be assumed here that, for each the correctable and uncorrectable errors, the error correction information includes a real page address in the flash memory 125 where the error has occurred. The error detection section 524 functions as an attenuating section which, when the error is detected on the waveform samples for the channel by the error correction section 111 and not correctable, rapidly attenuates the musical tone of the corresponding channel.

The error detection section 524 inputs thereto the error correction information from the error correction section 111. Once the error correction information indicative of an uncorrectable error is input, the error detection section 524 instructs the amplitude envelope generator (EG) 503 to effect "forced dump" of the channel in question to thereby rapidly attenuate a tone of the channel (dotted-line arrow 545), but also informs the CPU 101 of the error (dotted-line arrow 542).

The error detection section 524 receives, from the readout section 507, a PB address identifying a buffer region of the waveform memory 126 on which the tone generator 114 is currently performing data reading (such a PB address will hereinafter be referred to as "read PB address") (dotted-line arrow 544). The error detection section 524 receives, from the B-to-M transfer buffer 110, an address identifying a buffer region of the waveform memory 126 which is currently a transfer destination of data from the transfer buffer 109 (such an address will hereinafter be referred to as "transfer PB address"), and receives, upon completion of the transfer, a transfer end signal indicating that the transfer has ended (dotted-line arrow 543). When transfer and readout using the buffers Bia and Bib provided in the waveform memory 126 are being performed normally for a given channel, and if the read PB address is "Bia" (i.e., designating the buffer Bia), operations should progress as follows. Namely, the transfer PB address varies to "Bib" so that transfer from the buffer Bib is started, then a transfer end signal is input upon completion of the transfer, then the read address varies to "Bib" so that readout from the buffer Bib is started, then the transfer PB address varies to "Bia" so that transfer from the buffer Bia is started, then a transfer end signal is input upon completion of the transfer, then the read address varies to "Bia" so that readout from the buffer Bia is started, and so on. If the transfer cannot be performed in time for the readout for some reason, the read address varies to "Bib" before a transfer end signal is generated with the transfer PB address set at "Bib", and the read address varies to "Bia" before a transfer end signal is generated with the transfer PB address set at "Bia". The error detection section 524 checks whether such a transfer error has occurred and hence has been detected, and, if a transfer error has occurred, the error detection section 524 instructs the amplitude EG 503 to effect forced dump of the channel to thereby rapidly attenuate a tone of the channel (dotted-line arrow 545), but also informs the CPU 101 of occurrence of the transfer error along with the channel number (dotted-line arrow 542).

Figure 6:
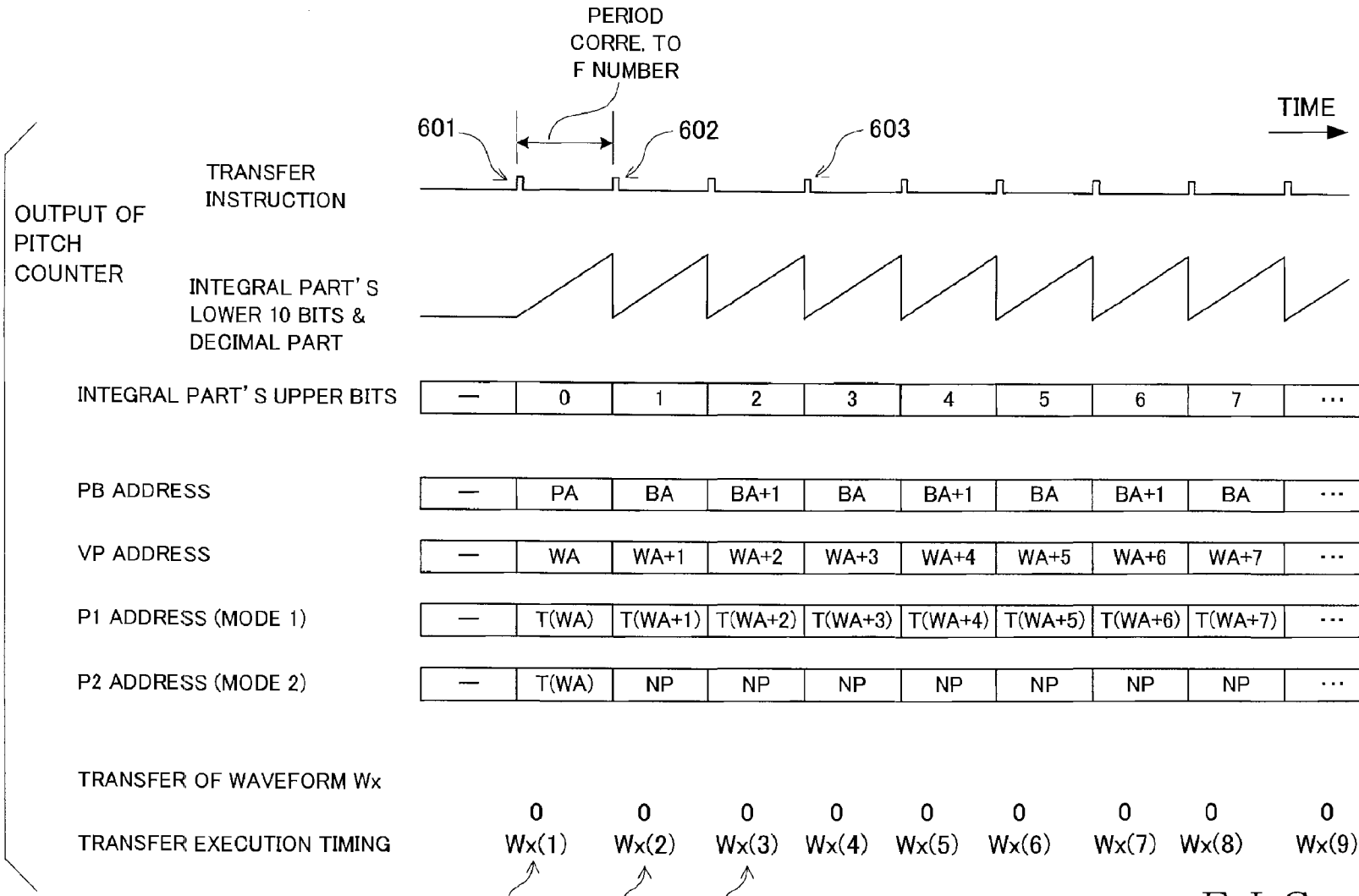
FIG. 6 is a diagram showing variation over time of various addresses (for one channel) following the start of tone generation.

FIG. 6 shows variation over time of various addresses (for one channel) following the start of tone generation. In the figure, "Integral Part's Lower 10 Bits & Decimal Part" indicates variation over time of the integral part's lower ten bits and decimal part of an accumulated result obtained by the pitch counter 504 of FIG. 5 accumulating the F number of the channel in question. The value of the integral part's lower ten bits and decimal part increases in response to the accumulation of the F number, then produces a carry once the lower ten bits exceed 1,023 so that it returns to "0" (to be exact, a value below "1" because a value of the decimal part is still left), and then increases again. Thus, the value of the integral part's lower ten bits and decimal part presents variation of a saw-tooth shape. "Integral Part's Upper Bits" indicates variation over time of the integral part's upper bits of the pitch counter 504 (i.e., an upper portion of the accumulated result with the integral part lower ten bits and decimal part excluded therefrom). The value of the integral part's upper bits is "0" immediately following the start of tone generation and then increases by one each time a carry is produced in the integral part's lower ten bits and decimal part.

Further, in FIG. 6, "Transfer Instruction" indicates a transfer instruction signal output from the pitch counter 504 of FIG. 5 to the transfer queue 521. The transfer instruction signal is output as indicated at 601 at the start of tone generation, and then output as indicated at 602 or 603 each time a carry is produced in the integral part's lower ten bits and decimal part. "PB Address" indicates variation over time of the PB address of the channel in question output from the PB address generation section 506 of FIG. 5. As the PB address, PA (which is an address indicative of the leading page in the pre-load area 302 of the waveform memory 126 (FIG. 3A)) is output immediately following the start of tone generation, and then BA and BA+1 (BA is an address of the buffer Bia corresponding to the channel while BA+1 is an address of the buffer Bib corresponding to the channel) are output alternately each time the value of the "integral part's upper bits" is counted up.

Further, "VP Address" indicates variation over time of the VP address of the channel in question internally generated by the VP address generation section 505 of FIG. 5. Because a page to be next read out to the waveform memory 126 is a page designated by the second-page address WA of waveform data in question (see FIG. 2B), WA is output as the VP address immediately following the start of tone generation and then increases by one each time the value of the "integral part's upper bits" is counted up. Each time a transfer instruction of the channel in question is received, the VP address generation section 505 generates the VP address of the channel by adding the value of the "integral part's upper bits" to the second-page address WA. Because the waveform data are sequentially stored in pages successively arranged in the virtual address space, the VP address generation section 505 may generate the VP address by incrementing the second-page address WA each time a transfer instruction of the channel in question is received. In the illustrated example of FIG. 2B, WA indicates the second page W2(1)+Inf, WA+1 indicates the third page W2(2)+Inf, and so on.

"P1 Address (Mode 1)" indicates a real page address corresponding to a VP address of the channel in question that is a virtual page address generated by the VP address generation section 505 in each time section in Mode 1. In Mode 1, a real page address corresponding to a virtual page address is acquired basically with reference to the address conversion table 301. Because, while the tone generator 114 is reading out waveform samples of the leading page Wx(0) with the PB address (=PA), the VP address that is a virtual page address of a page to be next read out from the flash memory 125 is a "WA" address, the VP address generation section 505 acquires a real page address T(WA), corresponding to the WA address, by reference to the address conversion table 301 and writes the thus-acquired real page address T(WA) to the NPAi of the channel in question. Note that "T(*)" represents a real page address corresponding to a virtual page address * obtained via the address conversion table 301. Each time a transfer instruction is received, the VP address generation section 505 acquires a real page address corresponding to a VP address WA+1, WA+2 or the like and sets the thus-acquired real page address to the NPAi of the waveform memory 126.

"P2 Address (Mode 2)" indicates a real page address corresponding to a VP address of the channel in question generated by the VP address generation section 505 in each time section in Mode 2. In Mode 2, a real page address to be next read out, is basically acquired by following the "pointer NP to a next page" included in the additional information Inf of a page read out from the flash memory 125. Because, while the tone generator 114 is reading out waveform samples of the leading page Wx(0) with the PB address set at PA, the VP address generation section 505 obtains a real page address T(WA), corresponding to the WA address, by reference to the address conversion table 301 and writes the thus-acquired real page address T(WA) into the NPAi of the channel in question. Page data of the real page address NPAi are read out from the flash memory 125 and stored into a corresponding one of the buffers of the waveform memory 126, at which time the B-to-M transfer buffer 110 sets the "pointer NP to a next page", included in the additional information Inf of the page data read out to the transfer buffer 109, into the NPAi of the channel in question in the waveform memory 126. The "pointer NP to a next page" thus set in the NPAi becomes a real page address corresponding to the next VP address (=W+1). When the VP address is updated to "WA+1" in response to a next transfer instruction 602, setting of the NPAi of the channel in question has already been completed. Similarly, at each of transfer execution timing 612, 613, . . . , the "pointer NP to a next page" is set into the NPAi region, so that, in effect, real page addresses corresponding to individual VP addresses are set into the NPAi region.

Further, in FIG. 5, "Transfer Execution Timing" indicates timing at which the F-to-B transfer section 108 and B-to-M transfer buffer 110 actually execute, for the channel in question, the transfer, explained above in relation to FIG. 4, in response to instructions from the F-to-B transfer instruction section 522 and B-to-M transfer instruction section 523 of FIG. 5. The transfer by the F-to-B transfer section 108 and B-to-M transfer section 110 is executed sequentially in the same order channel numbers were registered into the transfer queue 521 as noted above. Thus, even if channel numbers of other channels have already been registered in the transfer queue 521 when the channel number of the channel in question is registered into the transfer queue 521, the channel number of the channel in question is output from the transfer queue 521 and the transfer corresponding to the channel number of the channel in question is executed at timing 611 slightly after execution of all the transfer corresponding to the other channels' numbers has been completed. Similarly, the transfer of the channel number registered into the transfer queue 521 in response to the transfer instruction 602 is executed at timing 612 slightly later than the transfer instruction, the transfer of the channel number registered into the transfer queue 521 in response to the transfer instruction 603 is executed at timing 613 slightly later than the transfer instruction, and so on; namely, the transfer of each of the channel number is executed at timing slightly later than the transfer instruction. Such delays are not constant due to a crowdedness of the transfer being executed in the other channels. Needless to say, each transfer registered in the transfer queue 521 has to be executed before arrival of a next transfer instruction; namely, the transfer registered into the transfer queue 521 in response to the transfer instruction 601 has to be executed before arrival of the transfer instruction 602, the transfer registered into the transfer queue 521 in response to the transfer instruction 602 has to be executed before arrival of the transfer instruction 603, and so on.

Next, a description will be given about a timing design pertaining to access to the waveform memory 126.

In the instant embodiment, 1,024 samples transferred to the transfer buffer 109 in response to one unit access (readout of one-page data from the flash memory 125) are burst-transferred from the transfer buffer 109 to the waveform memory 126 dividedly in four DAC periods, 256 samples (512 bytes) per DAC period (FIG. 4). The reason why the waveform samples are burst-transferred dividedly in four DAC periods, 256 samples (512 bytes) per DAC period, is that four DAC periods are taken per unit access. A time period that is equal to one DAC period with time periods for the burst transfer and for the refreshing of the waveform memory 126 excluded therefrom becomes a time period for the tone generator 114 to read out waveform samples for tone generation of each of the tone generating channels. Thus, in a case where a great time period has to be secured for the burst transfer, it is necessary to reduce the readout time period for the individual tone generating channels, which therefore results in a design need to reduce the number of channels capable of tone generation. Stated conversely, if the burst transfer time period can be reduced, the number of channels capable of tone generation can be increased accordingly.

The following explain terms "band width" and "total band width" used hereinbelow. The term "total band width" refers to a maximum number of pages that can be read out from the flash memory 125 within a basic reproduction period that is a reproducing time period required when sample data of one page are reproduced at a rate of one sample per sampling period. In other words, the "total band width" refers to a maximum (upper-limit) number of times the transfer instruction can be issued within the basic reproduction period. In the instant embodiment, the basic reproduction period is set to equal 1,024 DAC periods, and four DAC periods are taken to read out one page from the flash memory 125. Thus, in the instant embodiment, the "total band width" is 256. The term "band width" refers to a maximum number of pages that can be read out from the flash memory 125 within the basic reproduction period in one channel, i.e. a maximum number of times the channel in question can issue the transfer instruction. For example, in a case where tone generation is performed in a given channel with the F number of "1", only one transfer instruction issued within the basic reproduction period of 1,024 DAC periods is sufficient because 1,024 samples written into the waveform memory through the one transfer can cover the reproduction with the F number of "1", thus, the band width of the given channel is "1". If the F number is "2", then the band width is "2". Further, if the F number is "1.1", eleven transfer instructions (i.e., transfer of 11 pages) are required in ten basic reproduction periods, and thus, two transfer instructions have to be issued somewhere in the ten periods; therefore, in this case, the band width of the channel in question is "2". Thus, a value obtained by truncating the decimal part of the F number becomes the band width of the channel. Further, there is a need to prevent a sum of the band widths of all of the channels from exceeding the total band width, because a transfer request generated in any one of the channels cannot be addressed if the sum of the band widths of all of the channels exceeds the total band width.

In the instant embodiment of the tone generation apparatus (system), the CPU 101 manages the band widths allocated to the individual channels. The total band width Tbw is determined in advance on the basis of various design conditions. Also, there are provided in advance a local variable Abw indicative of an allocated total band width and a local variable Cbw(i) indicative of a band width allocated to an i-th channel, and the CPU 101 initializes these local variables Abw and Cbw to zero at the time of an initialization process. In allocating a channel to tone generation, the CPU 101 compares a band width bw of the channel and a value calculated by subtracting the allocated total band width Abw from the total band width Tbw (such a value is indicative of an empty bandwidth) and confirms that the former is equal to or smaller than the latter; if the former is greater than the latter, the band width of the channel cannot be allocated to tone generation. If the former is equal to or smaller than the latter, it means that there is still an available or allocatable band width, and thus, the band width bw of the channel is added to the allocated total band width Abw, and the band width bw of the channel is stored as the local variable Cbw(i). Once the channel in question is subjected to a tone deadening operation (i.e., the channel is silenced) and thus is released from tone generation, Cb(i) is subtracted from Abw, and Cbw(i) is reset to zero. In this manner, the CPU 101 constantly manages the allocated total band width Abw and allocatable band width Tbw−Abw. Thus, the aforementioned scheme employed in the instant embodiment can limit a total number of unit accesses for all of the channels within the total band width, which is an upper limit number of unit accesses, in the basic reproduction period, without restricting an upper limit value of the F number. Namely, in the basic reproduction period, the scheme employed in the instant embodiment can reduce the number of unit accesses for each channel where a downward pitch shift (pitch-down) has occurred although it requires an increased number of unit accesses for each channel where an upward pitch shift (pitch-up) has occurred. Thus, as a whole, the scheme employed in the instant embodiment can lower the upper limit number of unit accesses (i.e., total band width) in the basic reproduction period.

Figure 7A:
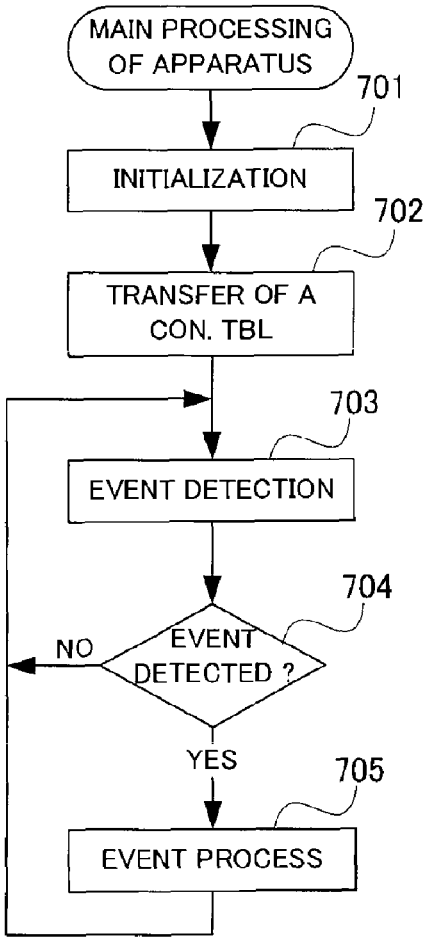
FIGS. 7A and 7B are flow charts of main processing and Note-On event process performed in the embodiment.

FIG. 7A is a flow chart of main processing performed by the CPU 101 in response to powering-on or resetting of the embodiment of the system of the present invention. Initialization is performed at step 701. At next step 702, the CPU 101 instructs the transfer control section 113 to transfer the address conversion table and the leading page of each waveform data group to the waveform memory 126, and initially sets mode information M, indicative of Mode 1 or Mode 2, into the mode resistor 501. As explained above in relation to FIG. 2, the address conversion table to be transferred at step 702 differs in type depending on the set mode information M. Namely, as the address conversion table, a 16-bit-input-and-16-bit-output table is transferred in Mode 1, while a 20-bit-input-and-20-bit-output table is transferred in Mode 2. After the initialization, the CPU 101 performs an event detection operation at step 703, and, if any event has been detected as determined at step 704, the CPU 101 performs, at step 705, an event process corresponding to the detected event. Thereafter, the CPU 101 repetitively performs the operations of steps 703 to 705.

Figure 7B:
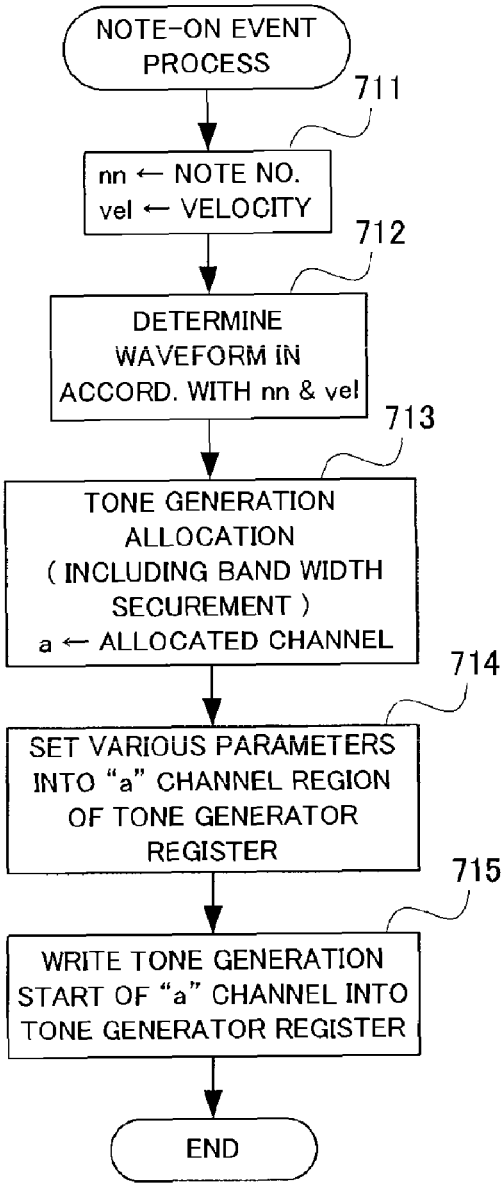

FIG. 7B is a flow chart of a Note-ON event process which is performed by the CPU 101 at step 705, for example, once a MIDI note-ON event is input via the MIDI I/O 124. At step 711, the CPU 101 sets a note number and velocity into respective registers nn and vel on the basis of performance information of the input MIDI note-ON event. At next step 712, the CPU 101 determines (selects) one waveform data set, corresponding to the note number and velocity nn and vel, from among a plurality of waveform data sets stored in the flash memory 125 and corresponding to a currently selected tone color. In the NOR-type flash memory 121 of FIG. 1, there are provided tone color data sets corresponding to various tone colors, and each of the tone color data sets includes waveform selection information for selecting a waveform data set corresponding to a note number and velocity nn and vel. At step 713, the CPU 101 allocates one of the tone generating channels and sets the channel number of the allocated channel into a register a.

At step 713, the CPU 101 secures the above-mentioned band width. Namely, the CPU 101 confirms that the condition "bw≦Tbw−Abw" is currently met and sets bw as Cbw(a) and Abw+bw as Abw. If bw>Tbw−Abw, namely, if the allocatable band width Tbw has no more allocatable band width, the CPU 101 determines a to-be-silenced channel from among channels currently generating tones (i.e., currently-sounding channels). Then, it rapidly attenuates the tone of the determined to-be-silenced channel to release the to-be-silenced channel from tone generation, subtracts the band width of the channel from the allocated total band width Abw, sets the local variable Cbw at "0", and then secures a band width again. If there is no empty channel to be allocated, then any one of the currently sounding channels is silenced and made allocatable to tone generation (i.e., a tone to be newly generated).

At next step 714, the CPU 101 sets various parameters into "a" channel regions of the control register section 502. The F number, intended to control pitch shifts, can be determined on the basis of a pitch difference (in cents) between a pitch (cents) when the determined waveform data is not pitch-shifted and a pitch (cents) indicated by the note number nn. The above-mentioned addresses WA and PA and envelope-related parameters are included in tone color data. The above-mentioned BA address can be determined on the basis of the allocated channel number. Finally, at step 715, the CPU 101 writes a tone generation instruction of the "a" channel into a note-ON register, after which the note-ON process is brought to an end.

Now that various data have been set in tone generator registers including the note-ON register for the "a" channel in the aforementioned manner, tone generation processing is performed in the "a" channel through the operations explained above in relation to FIGS. 1 to 6. The tone generation processing is implemented by the aforementioned hardware components from the NAND-type flash memory 125 through to the tone generator 114, and thus, no interrupt is issued to the CPU 101.

Figure 8A:
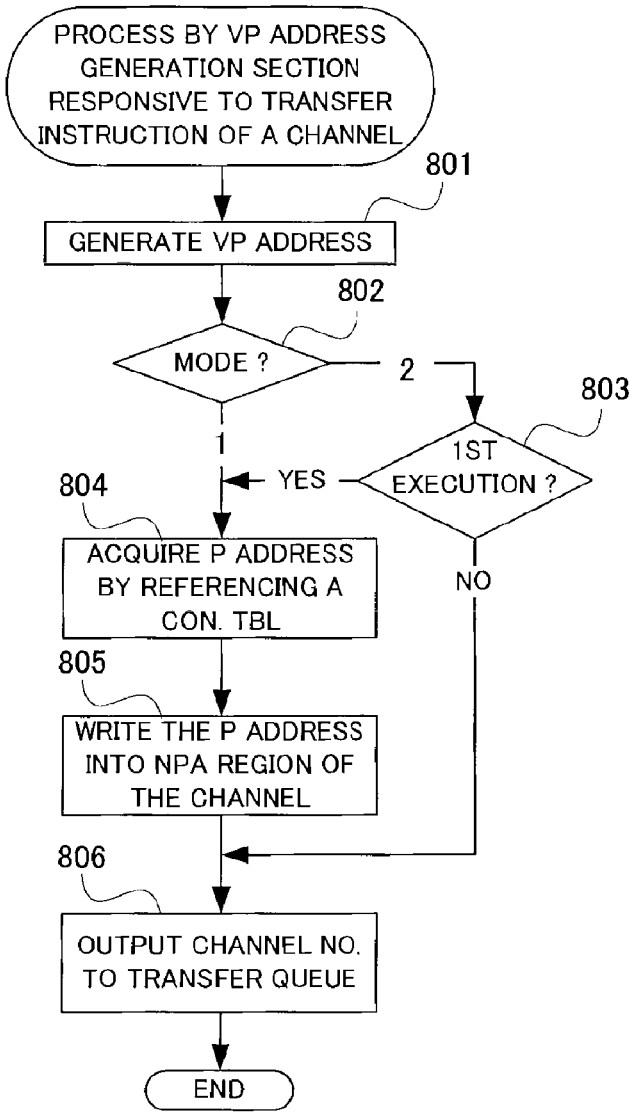
FIGS. 8A and 8B are flow charts of processes performed in a VP address generation section and in a B→M transfer section.

FIG. 8A is a flow chart of a process performed by the VP address generation section 505 upon receipt of a transfer instruction of a given channel, and this process is implemented by hardware. At step 801, a value of the "integral part's upper bits" is added to the second-page address WA to thereby generate a VP address, as explained above in relation to FIG. 6. If the current mode is Mode 1 as determined at step 802, or if the current mode is Mode 2 as determined at step 802 and the current process is a first execution of the process as determined at step 803, the process goes to step 804. If the current process is not a first execution as determined at step 803, the process goes to step 806. At step 804, a real page address (P address) corresponding to the VP address is acquired by reference to the address conversion table (301 of FIG. 3A). This P address corresponds to the P1 address in Mode 1 or the first P2 address in Mode 2. At step 805, the P address is written into the region NPAi of the channel in question provided in the NPA area 304. At next step 806, the channel number of the channel in question is output to the transfer queue 521.

Figure 8B:
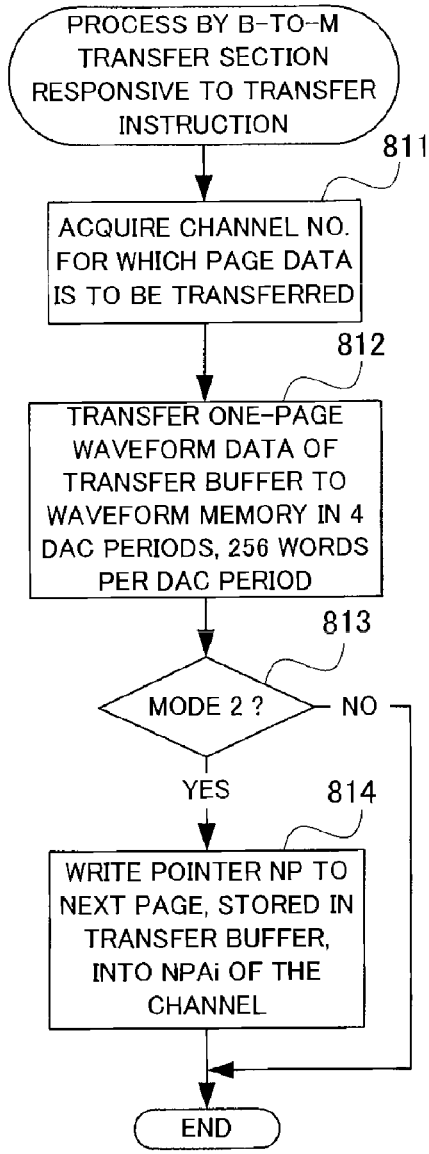

FIG. 8B is a flow chart of a process performed by the B-to-M transfer buffer 110 upon receipt of a transfer instruction from the B-to-M transfer instruction section 523. However, the process of FIG. 8B does not include the operation for outputting the transfer PB address etc. to the error detection section 524, and the like. This process too is implemented by hardware. At step 811, the channel number passed from the B-to-M transfer instruction section 523 is acquired. At step 812, 1,024 words of one-page waveform data stored in the transfer buffer 109 are transferred to the buffer region of the channel in question to the waveform memory 126 dividedly in four DAC periods, 256 words per DAC period. The transfer timing of the one-page waveform data is controlled as explained above in relation to the burst transfer time section 422 of FIG. 4. If the current mode is Mode 2 as determined at step 813, the process proceeds to step 814, where the "pointer NP to a next page", stored in the transfer buffer 109, is written into the region NPAi of the channel in question provided in the waveform memory 126.

The following describe processing performed by the CPU 101 in response to occurrence (detection) of an error. As explained above in relation to the error correction section 111 and error detection section 524 of FIG. 5, the CPU 101 in the instant embodiment of the system is supplied with an error notice containing any one of (1) error correction information indicating that a correctable error has occurred in data read out from the flash memory 125 and this error has been corrected, (2) error correction information indicating that an uncorrectable error has occurred in data read out from the flash memory 125, and (3) error correction information indicating that a transfer error has occurred. Such error correction information each includes data indicative of a channel and a real page address, in the flash memory 125, where the error has occurred.

First, the correctable error mentioned at (1) above is described. In this case, the tone generation in the channel in question is continued using the corrected waveform data. Upon receipt of the error notice, the CPU 101 registers, by an interrupt operation, the real page address of the page, where the error has occurred, into the NOR-type flash memory 121 as an "alternative-awaiting page". Because the tone generation in the channel in question is continued using the corrected waveform data as noted above, the correctable error notice is not immediately given to a user through a message display, output of a predetermined sound, or the like. However, such an error notice is given to the user after completion of the tone generation process. Upon receipt of the error correctable notice, the user starts a process of FIG. 9 to be performed in the case where there is a registration of "alternative-awaiting page", through a predetermined process responsive to a human operator's instruction (or automatically as a background process) while there is no access to the flash memory 125.

Figure 9A:
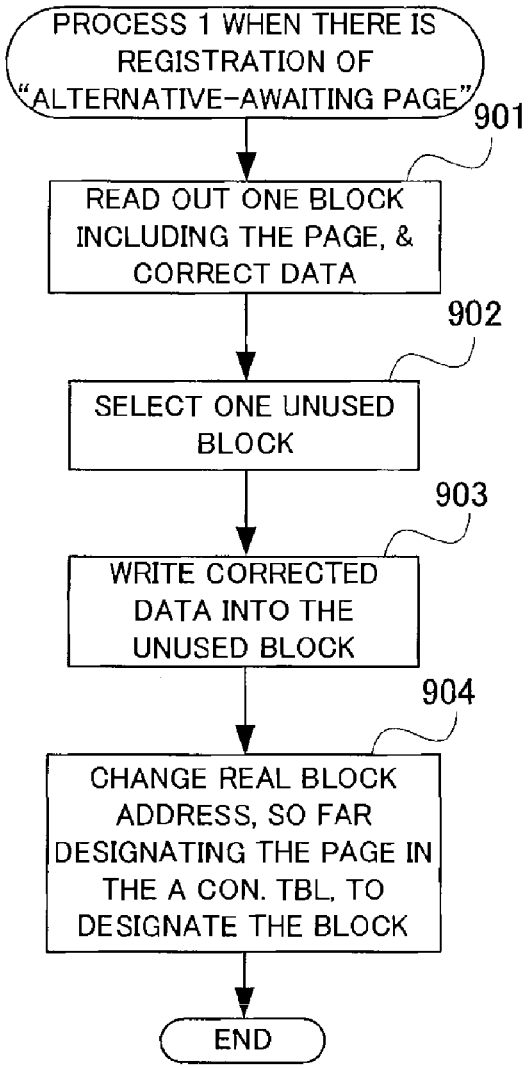
FIGS. 9A and 9B are flow charts of processes performed in a case where there is a registration of an "alternative-awaiting page".

FIG. 9A is a flow chart of the process performed in the case where there is a registration of "alternative-awaiting page" and where the current mode is Mode 1. At step 901, the CPU 101 reads out one block containing the error page, registered as the "alternative-awaiting page", from the flash memory 125 via the memory I/F 107, and performs, in the RAM 103, error correction on the error page contained in the block. The CPU 101 attaches error correction code to the corrected data, to thereby obtain an appropriate one-page data (2,112 bytes). In addition to the error page, the CPU 101 may perform an error check and correction on other pages of the block using error correction code. Once appropriate data are obtained for the entire block, the CPU 101 goes to step 902 to select an unused real block stored in the flash memory 125. Then, at step 903, the CPU 101 writes data of the corrected one block into the selected unused block (also referred to as "alternative block") via the memory I/F 107. At next step 904, the CPU 101 changes a real block address, associated with a virtual block address of the one block containing the error page in the address conversion table of the flash memory 125 (i.e., so far designating the error page in the address conversion table), to a real block address of the alternative block (i.e., so as to designate the alternative block). In the aforementioned manner, the one block containing the error page can be replaced with the alternative block.

In the case where the current mode is Mode 1, the same data as the address conversion table of the flash memory 125 and management data for managing locations of unused real blocks are prestored in the NOR-type flash memory 121 or in the RAM 103. Using these data, the CPU 101 always manages status of use of the individual pages of waveform data stored in the NAND-type flash memory 125.

Figure 9B:
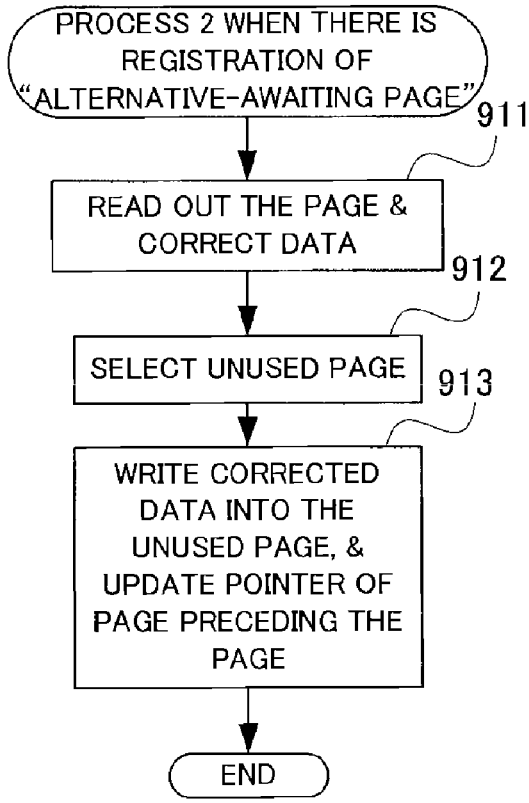

FIG. 9B is a flow chart of the process performed in the case where there is a registration of "alternative-awaiting page" and where the current mode is Mode 2. At step 911, the CPU 101 reads out the error page, registered as the "alternative-awaiting page", from the flash memory 125 via the memory I/F 107, and performs, in the RAM 103, error correction on the error page. The CPU 101 attaches error correction code to the corrected data, to thereby obtain an appropriate one-page data (2,112 bytes). At step 912, the CPU 101 selects an unused page stored in the flash memory 125. Then, at step 913, the CPU 101 writes data of the corrected page into the selected unused page (also referred to as "alternative page") and updates the "pointer NP to a next page" of a page preceding the page in question so as to point to the alternative page. If the error page is the leading page of the waveform data, the CPU 101 changes a real page address, associated with a virtual page address of the error page in the address conversion table of the flash memory 125, to a real page address of the alternative page, instead of updating the "pointer NP to a next page" of the preceding page. In the aforementioned manner, the error page can be replaced with the alternative page.

In the case where the current mode is Mode 2, the same data as the address conversion table of the flash memory 125 and management data for managing locations of unused real pages are prestored in the NOR-type flash memory 121 or in the RAM 103. The CPU 101 can acquire a real page address of the leading page of the waveform data containing the error page by reference to the address conversion table stored in the NOR-type flash memory 121, and it can identify a page preceding the error page by following the "pointer NP to a next page" from the leading page. Note that management data for managing a sequence of real pages (status of links between the pages) in the individual waveform data so that the page preceding the error page can be identified on the basis of the management data. Further, the additional information Inf may include not only the "pointer NP to a next page" but also a "pointer to a preceding page" so that a real page address of the page preceding the error page can be readily identified and thus access can be readily made to the preceding page.

Note that the NAND-type flash memory 125 cannot be overwritten by one action and has to be overwritten after erasing a block of a plurality of successive pages (e.g., 32 or 64 pages) including a page to be overwritten; such a block will hereinafter be referred to as "memory block" to distinguish from the block explained above in relation to FIG. 2C. Thus, the operations of step 903, 904 and 913 for writing into the NAND-type flash memory 125 are performed in such a sequence where data of a memory block including a page to be written are read out to the RAM 103 for the time being, then the read-out memory block is erased, then a necessary portion of the read-out data is changed in the RAM 103 and then the thus-changed data are written back to the erased memory block.

Next, the uncorrectable error mentioned at (2) above is described. In this case, the tone being generated in the channel in question is automatically force-dumped with no instruction from the CPU 101, as set forth above. The CPU 101, having received the uncorrectable error notice, performs interrupt operations for releasing the channel in question so as to be allocatable to tone generation, returning the band width, allocated to the channel in question, to the allocatable band width and informing the user to that effect through a message display, output of a predetermined sound, or the like. This information or notice may be given to the user either immediately or after completion of the tone generation process. The user, having received the notice, asks a manufacturer of the apparatus or the like for necessary repair because it appears the uncorrectable error is due to failure of the flash memory 125.

Talking of a given page of the flash memory 125, there is an extremely low possibility that an uncorrectable error occurs abruptly in the page from a state where the page is being read out normally with no error; it is ordinary that first a correctable error occurs several times and then an uncorrectable error occurs. Therefore, by replacing a page, having caused a correctable error, with an alternative page or alternative block when the correctable error has occurred as noted above can prevent occurrence of an uncorrectable error.

Next, the transfer error mentioned at (3) above is described. In this case, the tone being venerated in the channel in question is force-dumped as set forth above. The CPU 101, having received the error notice, performs interrupt operations for releasing the channel in question so as to be allocatable to tone generation, returning the band width, allocated to the channel in question, back to the allocatable band width. Further, the CPU 101 lowers the value of the total band width Tbw by a predetermined value or amount to tighten the band width limitation such that a transfer error is less likely to occur.

The various values mentioned above in the description of the instant embodiment may be modified as appropriate. For example, the flash memory 125 is not limited to the page size of 2,112 bytes and may be of any other desired size. For example, the data area may have a size of 1,024 bytes or 4,096 bytes, and the additional information Inf too may have any desired size, depending on the specifications of the flash memory 125. Further, the unit data width of the flash memory 125 is not limited to 8 bits and may be 4 bits, 16 bits or the like. Furthermore, the size of one block in the case of Mode 1 explained above in relation to FIG. 2C is not limited to 16 pages and may be 32 or 64 pages (i.e., power-of-2 pages), or the like. Furthermore, one block may consist of one page (consequently, in this case, there is no concept of "block"). The number of unit accesses in the basic reproduction period is not limited to 256 and may be any other desired number, such as 300, 450 or 512, depending on the specifications of the flash memory 125. Furthermore, the number of read-out samples from the waveform memory 126 is not limited to 256 (i.e., two samples×128 channels) and may be any other desired number, such as 310, 460 or 512, depending on the specification as to time resolution of a time slot in which one sample can be read out from the waveform memory 126. Furthermore, the number of channels capable of tone generation too is not limited to 128 channels and may be any other desired number, such as 64, 80 or 160, under various conditions that would become bottlenecks as noted above. The number of bits per sample too is not limited to 16 and may be 12, 14 or the like, Whereas the example of FIG. 2B has been described as being of the format where error correction code is provided following the waveform data of 2,048 bytes. The error correction code may be positioned at any other desired location or dividedly at a plurality of locations. For example, in a case where a data unit with which the error correcting arithmetic process is performed is 256 bytes, 256-byte error correction code may be positioned after 256-byte waveform data.

Further, whereas the interpolation performed by the interpolation section 508 in the embodiment has been described as two-point interpolation, the interpolation may be performed between any other desired number of points, such as three points or four-points. However, in the case where the interpolation section 508 performs four-point interpolation, there may be a need to reduce the number of channels capable of tone generation because four successive samples are read out through one readout operation. In the case where a plurality of samples are read out from the waveform memory 126, they may be read out at high speed by burst transfer. Further, the interpolation section 508 may be provided with a sample buffer.

Furthermore, whereas the readout section 507 in the embodiment has been described as constructed to access, per DAC period, the waveform memory 126, twice per channel, so as to read out two samples necessary for interpolation in the channel, an interpolation buffer (corresponding to a sample RAM in the conventionally-known apparatus) may be provided for storing latest n samples (n indicates a number necessary for the interpolation) of the read-out samples so that the necessary number of accesses to the waveform memory 126 per channel can be reduced. In such a case, the necessary number of accesses to the waveform memory 126 is equal to an increment of an integral part's address output from the pitch counter 504 for each of the channels. For example, if the F number of each of the channels is limited to equal to or less than "1", samples of 256 channels can be read out by 256 access operations per DAC period as in the above-described embodiment, and thus, the tone generator LSI 100 can be designed to achieve up to 256 channels capable of tone generation. If the F number is not limited, the maximum number of channels capable of tone generation dynamically changes in accordance with a maximum value of a sum of values obtained by truncating the decimal parts of the F numbers set in the individual channels. In each of the above-mentioned designs, it is optimal to design the tone generator LSI 100 in such a manner that the "band width" (256 in the above-described embodiment) of the flash memory 125 and the number of accesses (256 accesses in the above-described embodiment) to the waveform memory 126 agree with each other.

Furthermore, whereas the embodiment of the present invention has been described as constructed in such a manner that, in Mode 2, conversion from a virtual page address to a real page address of a page to be first transferred from the flash memory 125 (i.e., acquisition of T(WA) of the P2 address of FIG. 6) is automatically performed by the VP address generation section 505 rather than by the CPU 101 (see steps 803 and 804 of FIG. 8A), this initial address conversion may be performed by the CPU 101. For that purpose, read addresses (i.e., data corresponding to T(WA)) corresponding to virtual page addresses of individual waveform data may be retained by the CPU 101 so that, for any desired waveform data, the real page address can be set into the NPAi region of the waveform memory 126 via the control register section 502, for example, in response to a tone generation start instruction. Similar arrangements may be applied in Mode 1. What is important is that no interrupt is issued to the CPU 101 when the second and subsequent pages are to be transferred, and, for the first page, some increase of operations will not influence so much. Interrupts to the CPU 101 are not desirable in that they lead to an increased burden on the CPU 101 because evacuation of registers of the CPU 101 and the like are required.

Furthermore, whereas the embodiment of the present invention has been described as storing waveform data in the NAND-type flash memory as an external storage medium, such an external storage medium is not limited to the NAND-type flash memory. The basic principles of the present invention are extensively applicable to cases where waveform data are stored in any of various semiconductors as the external storage medium that is capable of being accessed at high speed on a page-by-page basis and that may cause such a data error as to require data correction.

Furthermore, whereas the embodiment of the present invention has been described above in relation to linear waveform data where each sample comprises one word, the waveform data may be data compressed in a desired format. In such a case, it is preferable to obtain in advance an average number of samples in one page for each of the waveform data and calculate a band width using the average number of samples, although it would become difficult to accurately calculate the above-described band width because the number of samples in per page (1,024 words) would differ.

Furthermore, whereas the embodiment of the present invention has been described as providing the address conversion table in the waveform memory, a storage section for storing the address conversion table may be provided in the LSI 100 rather than in the waveform memory. Furthermore, the embodiment of the present invention has been described as having the CPU 101 incorporated in the LSI 100. Alternatively, a CPU I/F section for interfacing between the LSI 100 and the CPU 101 may be incorporated in the LSI 100 in such manner that the LSI 100 can be controlled via the external CPU 101'. Furthermore, desired one or more of the memory I/F 102, RAM 103, display I/F 104, parallel I/F 105 and serial I/F 106 may be provided outside the LSI 100 rather than being incorporated in the LSI 100. Conversely, the waveform memory 126 may be modified into a static memory type and may be incorporated in the tone generator LSI 100.

The present application is based on, and claims priorities to, Japanese Patent Application No. 2010-066569 filed on Mar. 23, 2010, Japanese Patent Application No. 2010-066570 filed on Mar. 23, 2010 and Japanese Patent Application No. 2010-066571 filed on Mar. 23, 2010. The disclosure of the priority applications, in its entirety, including the drawings, claims, and the specification thereof, is incorporated herein by reference.

What is claimed is:

1. A tone generation apparatus comprising:

an external memory which has a plurality of pages, each page specified by a page address and storing data and error check code for the data therein, said external memory storing a plurality of waveforms as data, each of the waveforms consisting of a series of waveform samples and divided into a plurality of pages of waveform samples in said external memory;

a tone generating section which is able to generate a plurality of channels of musical tones simultaneously; and a control section which controls tone generation in said tone generating section in accordance with performance information, wherein said tone generating section comprises:

a waveform memory which has a plurality of leading waveform storage areas provided for the plurality of waveforms, and a plurality of buffer areas provided for the plurality of channels, one leading waveform storage area for a waveform storing the waveform samples of a leading page of the waveform, and one buffer area for a channel temporarily storing waveform samples for tone generation of a musical tone of the channel;

a control register section which has a plurality of channel areas provided for the plurality of channels, each channel area for a channel storing parameters, for controlling tone generation of a musical tone of the channel, to be set by said control section, the parameters of a channel including: a rate parameter for controlling a pitch of the musical tone; a leading waveform address specifying a leading waveform region in said waveform memory; waveform position information indicative of a position of a waveform in said external memory; and amplitude control information for controlling an amplitude envelope of the musical tone;

a readout section which, in response to an activation instruction for each of the channels, first reads out, at a rate corresponding to the rate parameter of the channel, the waveform samples of the leading page from the leading waveform storage area, in said waveform memory, designated by the leading waveform address of the channel, and then repetitively reads out, at the same rate, waveform samples from a buffer area corresponding to the channel in said waveform memory, said readout section capable of reading out waveform samples in said waveform memory for the plurality of channels simultaneously in time division multiplexing manner;

a next-address generating section which, for each of the channels, generates, on the basis of the waveform position information of the channel, next page address information designating a page of waveform samples to be read out next from said external memory and sets the generated next page address information of the channel into a next page address storage section;

a transfer instruction generation section which, for each of the channels, generates a transfer instruction each time waveform samples readout performed by said readout section for the channel progresses by one page;

a transfer queue which, in response to the activation instruction and the transfer instruction of any channel, enqueues thereto a channel number of the channel;

a transfer section which dequeues the channel number of a channel from said transfer queue on a first-in-first-out basis, then reads out the waveform samples of the page, designated by the next page address information of the channel set in the next page address storage section, from said external memory in a burst manner, and then writes the read-out waveform samples into the buffer area corresponding to the channel;

an error correction section which performs error detection on the waveform samples of the page, read out for the channel from said external memory by said transfer section, using the error correction code of the page and, if an error is detected and correctable, execute correction of the error of the waveform samples;

an attenuating section which, when the error is detected on the waveform samples for the channel by said error correction section and not correctable, rapidly attenuates the musical tone of the channel being generated by said tone generating section; and an amplitude control section which, for each of the channels, controls an amplitude envelop of the waveform samples, read out by said readout section, in accordance with the amplitude control information of the channel to thereby generate a musical tone of the channel, wherein, when said control section receives performance information for newly starting a musical tone of a pitch, said control section allocates one of the plurality of channels to the musical tone to be newly generated, sets the rate parameter corresponding to the pitch, the leading waveform address, the waveform position information and the amplitude control information into the channel area for the one channel of said control register section and further issues an activation instruction for the channel.

2. The tone generation apparatus as claimed in claim 1, wherein, when any error has been detected by said error correction section, said attenuating section sends, to said control section, an error notice including information identifying a page in said external memory where the error has occurred and information indicating whether the error could be duly corrected, and wherein (1) if the error notice indicates that the detected error is a correctable error, said control section records, as an alternative-awaiting page, the information identifying the page where the error has occurred, and (2) if the error notice indicates that the detected error is an uncorrectable error, said control section issues a warning indicating that normal tone generation is impossible.

3. The tone generation apparatus as claimed in claim 2, wherein, when there is any page recorded as the alternative-awaiting page, said control section secures, through an automatically-started background process or through a process started in response to a user's instruction, an alternative page in said external memory, reads out waveform samples of the page recorded as the alternative page, performs error correction on the read-out waveform samples to obtain appropriate waveform samples if any error has occurred in readout of the waveform samples of the page recorded as the alternative page, and then stores the appropriate waveform samples into the alternative page to thereby replace the page, where the error has occurred, with the alternative page.

4. The tone generation apparatus as claimed in claim 1, wherein said attenuating section detects that writing, by said transfer section, of the waveform samples into the buffer areas was not performed in time for readout, by said readout section, of the waveform samples from the buffer areas, and, if the writing was not performed in time for the readout, said attenuating section rapidly attenuates the volume of the tone being generated in the channel and sends, to said control section, an error notice indicating that a transfer error has occurred, and wherein, upon receipt of the error notice, said control section outputs a warning indicating that normal tone generation is impossible.

5. The tone generation apparatus as claimed in claim 4, wherein said control section sets, a "total band width", a maximum number of pages capable of being read out from said external memory within a basic reproduction period in which waveform samples of the one page are read out at a rate of one sample per sampling period, and sets, as a "band width", a number of pages of waveform samples to be read out within the basic reproduction period, in accordance with the rate information of a tone to be generated in a given one of the channels, when the channel is to be allocated to tone generation is set, and wherein said control section controls allocation of channels to tone generation in such a manner that a sum of the band widths of all the channels allocated to the tone generation does not exceed the total band width, and reduces the total band width by a predetermined amount when a notice of the transfer error has been received.

6. The tone generation apparatus as claimed in claim 1, wherein said external memory is a NAND-type flash memory constructed of an independent integrated circuit.

7. The tone generation apparatus as claimed in claim 1, wherein said readout section includes a pitch counter which generates a count value advancing at a rate indicated by the rate parameter, and said transfer instruction generation section generates a transfer instruction each time the count value advances by one page.

8. A tone generation apparatus comprising:

an external memory which has a plurality of pages successively arranged in a virtual address space and stores a plurality of waveforms, each of the waveforms consisting of a series of waveform samples and divided into a plurality of pages of waveform samples, each of the plurality of pages of said external memory being specified by a virtual page address and storing a page of waveform samples;

a tone generating section which is able to generate a plurality of channels of musical tones simultaneously; and a control section which controls tone generation in said tone generating section in accordance with performance information, wherein said tone generating section comprises:

a waveform memory which has a plurality of leading waveform storage areas provided for the plurality of waveforms, and a plurality of buffer areas provided for the plurality of channels, one leading waveform storage area for a waveform storing the waveform samples of a leading page of the waveform, and one buffer area for a channel temporarily storing waveform samples for tone generation of a musical tone of the channel;

an address conversion table provided for converting the virtual page address, identifying a page in the virtual address space, into a real page address;

a control register section which has a plurality of channel areas provided for the plurality of channels, each channel area for a channel storing parameters, for controlling tone generation of a musical tone of the channel, to be set by said control section, the parameters of a channel including: a rate parameter for controlling a pitch of the musical tone; a leading waveform address specifying a leading waveform region in said waveform memory; waveform position information indicative of a position of a waveform in said external memory; and amplitude control information for controlling an amplitude envelope of the musical tone;

a readout section which, in response to an activation instruction for each of the channels, first reads out, at a rate corresponding to the rate parameter of the channel, the waveform samples of the leading page from the leading waveform storage area, in said waveform memory, designated by the leading waveform address of the channel, and then repetitively reads out, at the same rate, waveform samples from a buffer area corresponding to the channel in said waveform memory, said readout section capable of reading out waveform samples in said waveform memory for the plurality of channels simultaneously in time division multiplexing manner;

a next-address generating section which, for each of the channels, generates, on the basis of the waveform position information of the channel, a virtual page address designating a page of waveform samples to be read out next in the virtual address space of said external memory, converts the virtual page address to a real page address by reference to the address conversion table and then sets the converted real page address into a next page address storage section;

a transfer instruction generation section which, for each of the channels, generates a transfer instruction each time waveform samples readout performed by said readout section for the channel progresses by one page;

a transfer queue which, in response to the activation instruction and the transfer instruction of any channel, enqueues thereto a channel number of the channel;

a transfer section which dequeues the channel number of a channel from said transfer queue on a first-in-first-out basis, then reads out the waveform samples of the page designated by next page address information of the channel set in the next page address storage section, from said external memory in a burst manner, and then writes the read-out waveform samples into the buffer area corresponding to the channel; and an amplitude control section which, for each of the channels, controls an amplitude envelop of the waveform samples, read out by said readout section, in accordance with the amplitude control information of the channel to thereby generate a musical tone of the channel, wherein, when said control section receives performance information for newly starting a musical tone of a pitch, said control section allocates one of the plurality of channels to the musical tone to be newly generated, sets the rate parameter corresponding to the pitch, the leading waveform address, the waveform position information and the amplitude control information into the channel area for the one channel of said control register section and further issues an activation instruction for the channel.

9. The tone generation apparatus as claimed in claim 8, wherein said address conversion table is originally stored in said external memory, and, at a time of activation of said tone generation apparatus, said address conversion table is read out from said external memory and stored into an internal address conversion table storage section.

10. The tone generation apparatus as claimed in claim 8, wherein the address conversion table storage section is provided in said waveform memory.

11. The tone generation apparatus as claimed in claim 8, which further comprises: an error correction section which performs error detection on the waveform samples of the page, read out from said external memory by said transfer section, using error correction code of the page and, if an error is detected and correctable, execute correction of the error of the waveform samples;

an attenuating section which, when the error is detected on the waveform samples for the channel by said error correction section and correctable, sends, to said control section, an error notice including information indicating that the correctable error has been detected and identifying a page in said external memory where the error has occurred, and wherein (1) said control section records, as an alternative-awaiting page, the information identifying the page where the correctable error has occurred, (2) if there is any page currently recorded as the alternative-awaiting page, said control section secures, through an automatically-started background process or through a process started in response to a user's instruction, an alternative page in said external memory, reads out waveform samples of the page recorded as the alternative page, performs error correction to obtain appropriate waveform samples if an error has occurred in readout of the waveform samples of the page recorded as the alternative page, and then stores the appropriate waveform samples into the alternative page to thereby replace the page, where the error has occurred, with the alternative page, and (3) said control section modifies said address conversion table in such a manner that a real page address of the alternative page can be acquired when a virtual page address of the alternative-awaiting page is to be converted into a real page address.

12. The tone generation apparatus as claimed in claim 8, wherein said external memory is a NAND-type flash memory constructed of an independent integrated circuit.

13. The tone generation apparatus as claimed in claim 8, wherein said readout section includes a pitch counter which generates a count value advancing at a rate indicated by the rate parameter, and said transfer instruction generation section generates a transfer instruction each time the count value advances by one page.

14. A tone generation apparatus comprising:

an external memory which has a plurality of pages successively arranged in a virtual address space and stores a plurality of waveforms, each of the waveforms consisting of a series of waveform samples and divided into a plurality of pages of waveform samples, each of the plurality of pages of said external memory being specified by a virtual page address and storing a page of waveform samples and a real page address of a next page to be read out next;

a tone generating section which is able to generate a plurality of channels of musical tones simultaneously; and a control section which controls tone generation in said tone generating section in accordance with performance information, wherein said tone generating section comprises:

a waveform memory which has a plurality of leading waveform storage areas provided for the plurality of waveforms, and a plurality of buffer areas provided for the plurality of channels, one leading waveform storage area for a waveform storing the waveform samples of a leading page of the waveform, and one buffer area for a channel temporarily storing waveform samples for tone generation of a musical tone of the channel;

a control register section which has a plurality of channel areas provided for the plurality of channels, each channel area for a channel storing parameters, for controlling tone generation of a musical tone of the channel, to be set by said control section, the parameters of a channel including: a rate parameter for controlling a pitch of the musical tone; a leading waveform address specifying a leading waveform region in said waveform memory; and amplitude control information for controlling an amplitude envelope of the musical tone;

a readout section which, in response to an activation instruction for each of the channels, first reads out, at a rate corresponding to the rate parameter of the channel, the waveform samples of the leading page from the leading waveform storage area of said waveform memory designated by the leading waveform address, and then repetitively reads out, at the same rate, the waveform samples from the buffer area of said waveform memory corresponding to the channel;

a transfer instruction generation section which, for each of the channels, generates a transfer instruction each time waveform samples readout performed by said readout section for the channel progresses by one page;

a transfer queue which, in response to the activation instruction and the transfer instruction of any channel, enqueues thereto a channel number of the channel a next page address storage section which, for each of the channels, stores therein a real page address of a page to be read out next from said external memory;

a first next page address setting section which, at a time of starting of tone generation in each of the channels, writes, into said next page address storage section, a real page address of a page to be read out first;

a transfer section which dequeues the channel number of a channel from said transfer queue on a first-in-first-out basis, then reads out, from said external memory, waveform samples of the page of the real page address, set in said next page address storage section, to be read out next in the channel and then writes the read-out waveform samples into the buffer area of said waveform memory corresponding to the channel indicated by the channel number;

a second next page address setting section which, for each of the channels and when the waveform samples of the next page have been read out from said external memory by said transfer section, overwrites a real page address of a next page, included in the read-out page, into said next page address storage section; and an amplitude control section which, for each of the channels, controls an amplitude envelop of the waveform samples, read out by said readout section, in accordance with the amplitude control information to thereby generate a musical tone of the channel, wherein, when said control section receives performance information for newly starting a musical tone of a pitch, said control section allocates one of the plurality of channels to the musical tone to be newly generated, sets the rate parameter corresponding to the tone pitch, the leading waveform address and the amplitude control information into the channel area for the one channel of said control register section and further issues an activation instruction for the channel.

15. The tone generation apparatus as claimed in claim 14, wherein said external memory has, for each of a plurality of types of waveform, said plurality of pages successively arranged in the virtual address space, and said tone generation apparatus further comprises an address conversion table provided for converting, for each of the plurality of types of waveform, a virtual page address of a second page, which is to be read out next while the leading page in the virtual address space is being reproduced, into a real page address, wherein said control section sets, into the region of said control register section corresponding to the allocated channel, waveform position information indicative of a position, in said external memory, of the type of waveform to be used d for tone generation in the channel, in accordance with the performance information, and wherein, at a time of starting of tone generation, said first next page address setting section acquires a rear page address of a second page to be transferred first by referencing said address conversion table in accordance with the waveform position information, and then writes the acquired rear page address of the second page into said next page address storage section.

16. The tone generation apparatus as claimed in claim 14, wherein, for each of the plurality of types of waveform, said control section retains a real page address of a second page to be read out first from said external memory and then transferred to the buffer area and, at a time of starting of tone generation, supplies the real page address of the second page to said first next page address setting section, and said first next page address setting section writes the supplied real page address into said next page address storage section.

17. The tone generation apparatus as claimed in claim 14, which further comprises: an error correction section which performs error detection on the waveform samples of the page, read out for the channel from said external memory by said transfer section, using an error correction code of the page and, if an error is detected and correctable, execute correction of the error of the waveform samples;

an attenuating section which, when the error is detected on the waveform samples for the channel by said error correction section and correctable, sends, to said control section, an error notice including information indicating that the correctable error has been detected and identifying a page in said external memory where the error has occurred, and wherein (1) said control section records, as an alternative-awaiting page, the information identifying the page where the correctable error has occurred, (2) if there is any page currently recorded as the alternative-awaiting page, said control section secures, through an automatically-started background process or through a process started in response to a user's instruction, an alternative page in said external memory, reads out waveform samples of the page recorded as the alternative page, performs error correction to obtain appropriate waveform samples if an error has occurred in readout of the waveform samples of the page recorded as the alternative page, and then stores the appropriate waveform samples into the alternative page to thereby replace the page, where the error has occurred, with the alternative page, and (3) said control section modifies a real page address of a next page, included in a page preceding the alternative-awaiting page, to a real page address of the alternative-awaiting page.

18. The tone generation apparatus as claimed in claim 14, wherein said external memory is a NAND-type flash memory constructed of an independent integrated circuit.

19. The tone generation apparatus as claimed in claim 14, wherein said readout section includes a pitch counter which generates a count value advancing at a rate indicated by the rate parameter, and said transfer instruction generation section generates a transfer instruction each time the count value advances by one page.

* * * * *